US011795562B2

(12) United States Patent
Balucani

(10) Patent No.: US 11,795,562 B2
(45) Date of Patent: Oct. 24, 2023

(54) MAKING MULTI-COMPONENT STRUCTURES USING DYNAMIC MENISCI

(71) Applicant: Rise Technology S.R.L., Rome (IT)

(72) Inventor: Marco Balucani, Rome (IT)

(73) Assignee: Rise Technology S.R.L., Rome (IT)

( * ) Notice: Subject to any disclaimer, the term of this patent is extended or adjusted under 35 U.S.C. 154(b) by 72 days.

(21) Appl. No.: 17/281,922

(22) PCT Filed: Oct. 1, 2019

(86) PCT No.: PCT/IB2019/058328
§ 371 (c)(1),
(2) Date: Mar. 31, 2021

(87) PCT Pub. No.: WO2020/070635
PCT Pub. Date: Apr. 9, 2020

(65) Prior Publication Data
US 2022/0010449 A1 Jan. 13, 2022

(51) Int. Cl.
*C25D 5/04* (2006.01)
*C25D 5/10* (2006.01)
*C25D 5/02* (2006.01)

(52) U.S. Cl.
CPC ..... *C25D 5/04* (2013.01); *C25D 5/026* (2013.01); *C25D 5/10* (2013.01)

(58) Field of Classification Search
None
See application file for complete search history.

(56) References Cited

U.S. PATENT DOCUMENTS 6,495,005 B1 * 12/2002 Colgan ..... C25D 7/123 204/196.15
2005/0284748 A1 12/2005 Dordi et al.
(Continued)

FOREIGN PATENT DOCUMENTS

WO 9741594 A1 11/1997
WO 2020070635 A1 4/2020

OTHER PUBLICATIONS

K. Kholostov et al., "High uniformity and high speed copper pillar plating technique," 2014 IEEE 64th Electronic Components and Technology Conference (ECTC), Orlando, FL, USA, 2014, pp. 1571-1576, doi: 10.1109/ECTC.2014.6897503. (Year: 2014).*
(Continued)

*Primary Examiner* — Louis J Rufo
(74) *Attorney, Agent, or Firm* — Volpe Koenig

(57) ABSTRACT

A solution for making multi-component structures (145) is proposed. A corresponding method comprises delivering a plurality of galvanic solutions (115) at least in part different from each other through corresponding delivering ports (110) and removing the galvanic solutions (115) being delivered through a plurality of removing ports (120) thereby creating corresponding dynamic drops (125). Corresponding deposition currents (Ia-Id) are set individually for the galvanic solutions (115) as a function of an amount of the components of the galvanic solutions (115) in the multi-component structure (145). The substrate (130) and the dynamic drops (125) are brought into contact with each other in succession, thereby transforming the dynamic drops (125) into corresponding dynamic menisci (135*a*-135*d*) that galvanically deposit layers (140*a*-140*d*) of the corresponding components of the multi-component structure (145) onto the substrate (130). A corresponding deposition system (600; 700) is also proposed.

21 Claims, 17 Drawing Sheets

(56) References Cited

U.S. PATENT DOCUMENTS

| | | | | |
|---|---|---|---|---|
| 2013/0061920 | A1* | 3/2013 | Balucani | H01L 31/0352 205/124 |
| 2018/0012782 | A1 | 1/2018 | Balucani | |

OTHER PUBLICATIONS

Balucani et al (Energy Procedia 43 (2013) 54-65, as provided with the IDS dated Mar. 31, 2021). (Year: 2013).*

Balucani et al., "New selective processing technique for solar cells", 4th Workshop on Metallization for Crystalline Silicon Solar Cells, Energy Procedia 43, 2013, pp. 54 through 65, ScienceDirect.

International Searching Authority, "International Search Report and Written Opinion from PCT Application No. PCT/IB2019/058328", Dec. 6, 2019, pp. 1 through 14, Published: WO.

* cited by examiner

MAKING MULTI-COMPONENT STRUCTURES USING DYNAMIC MENISCI

This application claims priority to International Patent Application No. PCT/IB2019/058328 filed on Oct. 1, 2019.

TECHNICAL FIELD

The present invention relates to the field of industrial manufacturing. More specifically, this invention relates to the making of multi-component structures.

TECHNOLOGICAL CONTEXT

The background of the present invention is hereinafter introduced with the discussion of techniques relating to its context. However, even when this discussion refers to documents, acts, artifacts and the like, it does not suggest or represent that the discussed techniques are part of the prior art or are common general knowledge in the field relevant to the present invention.

Multi-component structures are used in several applications (such as in the electronic, chemical and so on field).

For example, with reference to the field of electronics, interconnection elements of electronic devices may be made with multi-component structures. Indeed, the interconnection elements generally comprise a portion of solder alloy for their mechanical and electrical connection to other electronic devices. In order to reduce the use of hazardous substances for the human health in the electronic devices, as required by regulatory restrictions as well in some countries such as the European Union, the tin-lead solder alloy being largely common in the past is increasingly replaced by lead-free solder alloys. For this purpose, the tin alone is not useable in practice, since at low temperatures it undergoes a phase transformation that makes it extremely fragile up to pulverize (with a phenomenon known as "tin pest"). Other components are then added to the tin in order to avoid its phase transition. The most common solder alloys are based on tin with the addition of silver and copper (known as SAC alloys). However, the SAC alloys struggle to meet the growing demands of the electronic applications (such as the passing of the burdensome "drop test"). Therefore, an additional component (such as manganese or zinc) is often added to the SAC alloys to improve the mechanical, weldability and reliability characteristics of the corresponding interconnection elements.

These solder alloys are made by mixing their (three or four) components in the due percentages. The solder alloys may then be applied on a substrate to make the desired interconnection elements via screen printing techniques. However, the screen printing techniques are inapplicable in micro-electronic applications because of the too much small size of the interconnection elements; for example, balls of solder alloys for interconnection elements of BGA type or caps of solder alloy on pillars of copper for interconnection elements of "copper pillar" type (in electronic devices of "flip-chip" type) have typical sizes lower than 100 μm, which are completely incompatible with the screen printing processes.

In this case, the interconnection structures might be made by depositing the solder alloy on the substrate via galvanic processes. However, the deposition of multiple components at the same time from a single galvanic solution is quite difficult (if not impossible) as the number of components increases. Indeed, the components generally have different reduction potentials; therefore, for the same voltage applied between the galvanic solution and the substrate the various components of the galvanic solution would deposit in a different way. Additives (usually organic ones) may be added to the galvanic solution in an attempt to make the reduction potentials of its components similar. However, already with two components, there are criticalities in the stability over time of the galvanic solution and in the uniformity of the interconnection elements; the deposition becomes poorly practical with three components and substantially unfeasible with four or more components.

The interconnection structures might then be made by depositing the various components of the solder alloy via subsequent galvanic processes (in corresponding galvanic baths each containing a galvanic solution of the corresponding component). However, the passage of the substrate among the different galvanic baths is complex, since each time the substrate is passed from a first galvanic bath to a second galvanic bath it is necessary to wash it thoroughly to avoid contaminations of the galvanic solution of the second galvanic bath with residues of the galvanic solution of the first galvanic bath. This significantly slows down the process, so that it is applicable at industrial level only when the number of layers is of very few units (2-3), and then relatively thick (for example, a few tens of μm). As a consequence, a subsequent thermal reflow process is required for mixing, at least partially, the components of the layers of the solder alloy; in any case, the solder alloy has criticalities in its homogeneity.

SUMMARY

A simplified summary of the present invention is herein presented in order to provide a basic understanding thereof; however, the sole purpose of this summary is to introduce some concepts of the invention in a simplified form as a prelude to its following more detailed description, and it is not to be interpreted as an identification of its key elements nor as a delineation of its scope.

In general terms, the present invention is based on the idea of using dynamic menisci to make multi-component structures.

Particularly, an aspect provides a method for making a multi-component structure. The method comprises delivering a plurality of galvanic solutions at least in part different from each other through corresponding delivering ports and removing the galvanic solutions being delivered through a plurality of removing ports thereby creating corresponding dynamic drops. Corresponding deposition currents are set individually for the galvanic solutions as a function of an amount of the components of the galvanic solutions in the multi-component structure. The substrate and the dynamic drops are brought into contact with each other in succession, thereby transforming the dynamic drops into corresponding dynamic menisci that galvanically deposit layers of the corresponding components of the multi-component structure onto the substrate.

A further aspect provides a deposition system for performing the method.

More specifically, one or more aspects of the present invention are set out in the independent claims and advantageous features thereof are set out in the dependent claims, with the wording of all the claims that is herein incorporated verbatim by reference (with any advantageous feature provided with reference to any specific aspect that applies mutatis mutandis to every other aspect).

BRIEF DESCRIPTION OF DRAWINGS

The solution of the present invention, as well as further features and the advantages thereof, will be best understood with reference to the following detailed description thereof, given purely by way of a non-restrictive indication, to be read in conjunction with the accompanying drawings (wherein, for the sake of simplicity, corresponding elements are denoted with equal or similar references and their explanation is not repeated, and the name of each entity is generally used to denote both its type and its attributes, like value, content and representation). In this respect, it is expressly intended that the drawings are not necessary drawn to scale (with some details that may be exaggerated and/or simplified) and that, unless otherwise indicated, they are merely used to illustrate the structures and procedures described herein conceptually. Particularly.

DETAILED DESCRIPTION

With reference in particular to FIG. 1A-FIG. 1F, the general principles are shown of the solution according to an embodiment of the present invention.

Figure 1A:
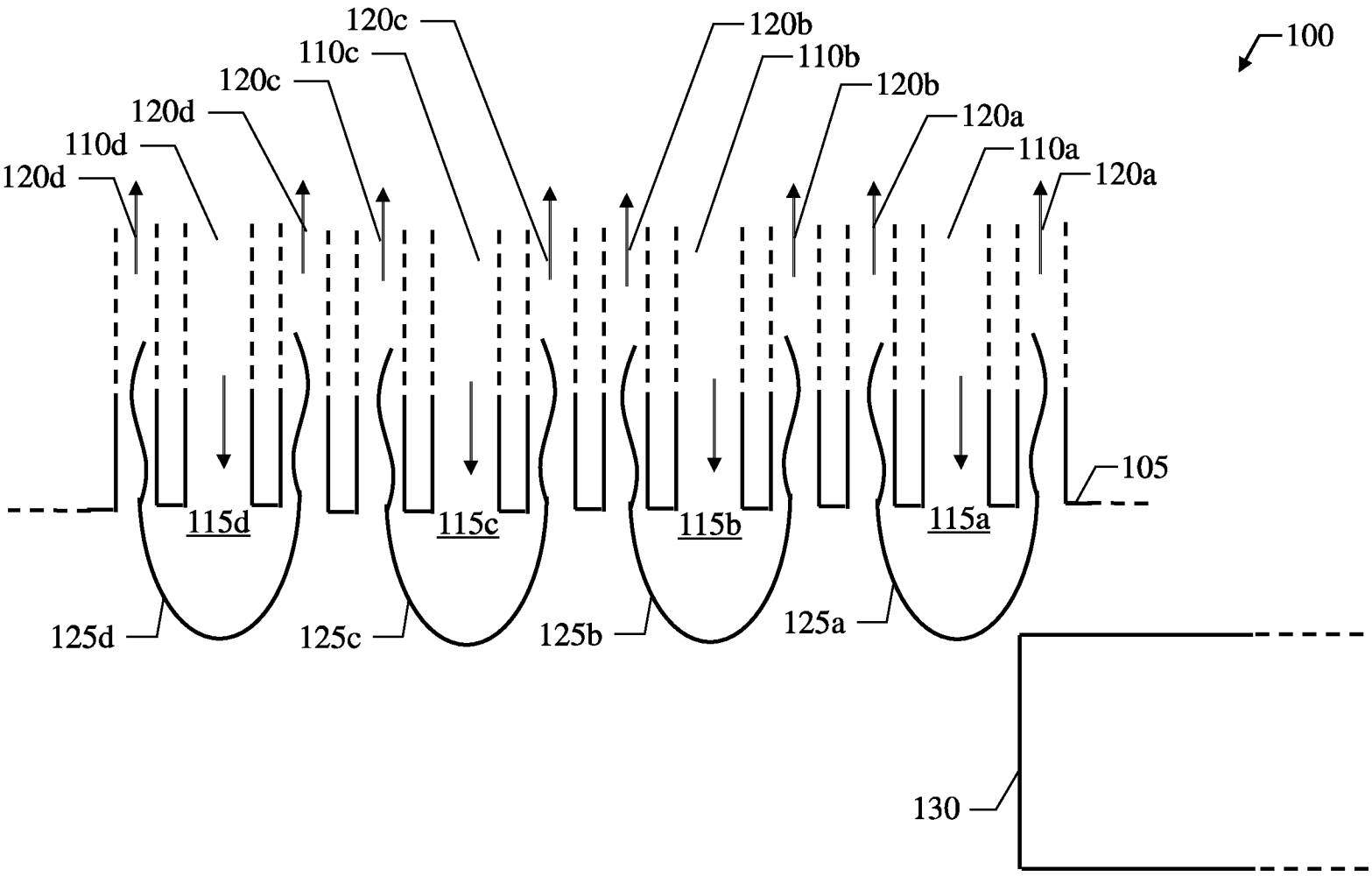
FIG. 1A-FIG. 1F show the general principles of the solution according to an embodiment of the present invention.

Starting from FIG. 1A, a deposition head 100 is used to make multi-component structures, each comprising a plurality of components (i.e., different chemicals). The deposition head 100 has an operative surface 105 (facing downwards in the figure). A plurality of delivering ports, four in the example at issue denoted with the references 110*a*, 110*b*, 110*c* and 110*d*, are open on the user interface 105. The delivering ports 110*a*, 110*b*, 110*c* and 110*d* are used to deliver galvanic solutions 115*a*, 115*b*, 115*c* and 115*d* for corresponding components Ca, Cb, Cc and Cd, respectively, of the multi-component structure (as schematically represented in the figure by means of arrows pointing downwards); the galvanic solutions 115*a*-115*d* are different from each other (at least in part).

A plurality of removing ports, four in the example at issue denoted with the references 120*a*, 120*b*, 120*c* and 120*d*, are open on the operative surface 105 as well; for each delivering port 110*a*, 110*b*, 110*c* and 110*d*, one (or more) of the removing ports 120*a*, 120*b*, 120*c* and 120*d*, respectively, is arranged around it (at least in part) on the user interface 105. The removing ports 120*a*, 120*b*, 120*c* and 120*d* are used to remove the galvanic solutions 115*a*, 115*b*, 115*c* and 115*d* have been delivered by the delivering ports 110*a*, 110*b*, 110*c* and 110*d*, respectively, on the user interface 105, without substantially losing them from the deposition head 100 (as shown schematically in the figure by arrows pointing upwards). As a result, dynamic drops 125*a*, 125*b*, 125*c* and 125*d* are formed at the delivering ports 110*a*, 110*b*, 110*c* and 110*d*, respectively (for example, around them). Each dynamic drop 125*a*-125*d* is formed by the galvanic solution 115*a*-115*d* that remains attached on the operative surface 105 (hanging therefrom in the example at issue) without any support; the dynamic drop 125*a*-125*d* is in a substantially fixed position on the operative surface 105 (i.e., its area of contact with the operative surface 105 does not vary significantly overtime). However, a content of the dynamic drop 125*a*-125*d* is continually refreshed by a flow of the galvanic solution 115*a*-115*d* that flows from the delivering port 110*a*-110*d* to the removing port 120*a*-120*d*. A size of the dynamic drop 125*a*-125*d* depends (statically) on sizes/shapes of the delivering port 110*a*-110*d* and of the removing port 120*a*-120*d* and on their mutual position on the operative surface 105 (arrangement and/or distance). In addition, the size of the dynamic drop 125*a*-125*d* may be controlled (dynamically) by varying the flow of the galvanic solution 115*a*-115*d* which is delivered by the delivering port 110*a*-110*d* and/or which is removed by the removing port 120*a*-120*d*. This allows obtaining dynamic drops 125*a*-125*d* of any desired size, even very small (for example, of the order of 10-1,000 μm in width and height).

One or more multi-component structures (not shown in the figure) are made on a substrate 130. For this purpose, deposition currents Ia, Ib, Ic and Id are set individually for the galvanic solutions 115*a*, 115*b*, 115*c* and 115*d*, respectively; the deposition currents Ia, Ib, Ic and Id are set as a function of a desired amount of the components Ca, Cb, Cc and Cd of the galvanic solutions 115*a*, 115*b*, 115*c* and 115*d*, respectively, in the multi-component structure (as described in detail below). The substrate 130 and the dynamic drops 125*a*-125*d* (individually or in groups) are brought into contact with each other in succession (for example, by sliding the substrate 130 under the deposition head 100, from the right to the left in the figure).

Figure 1B:
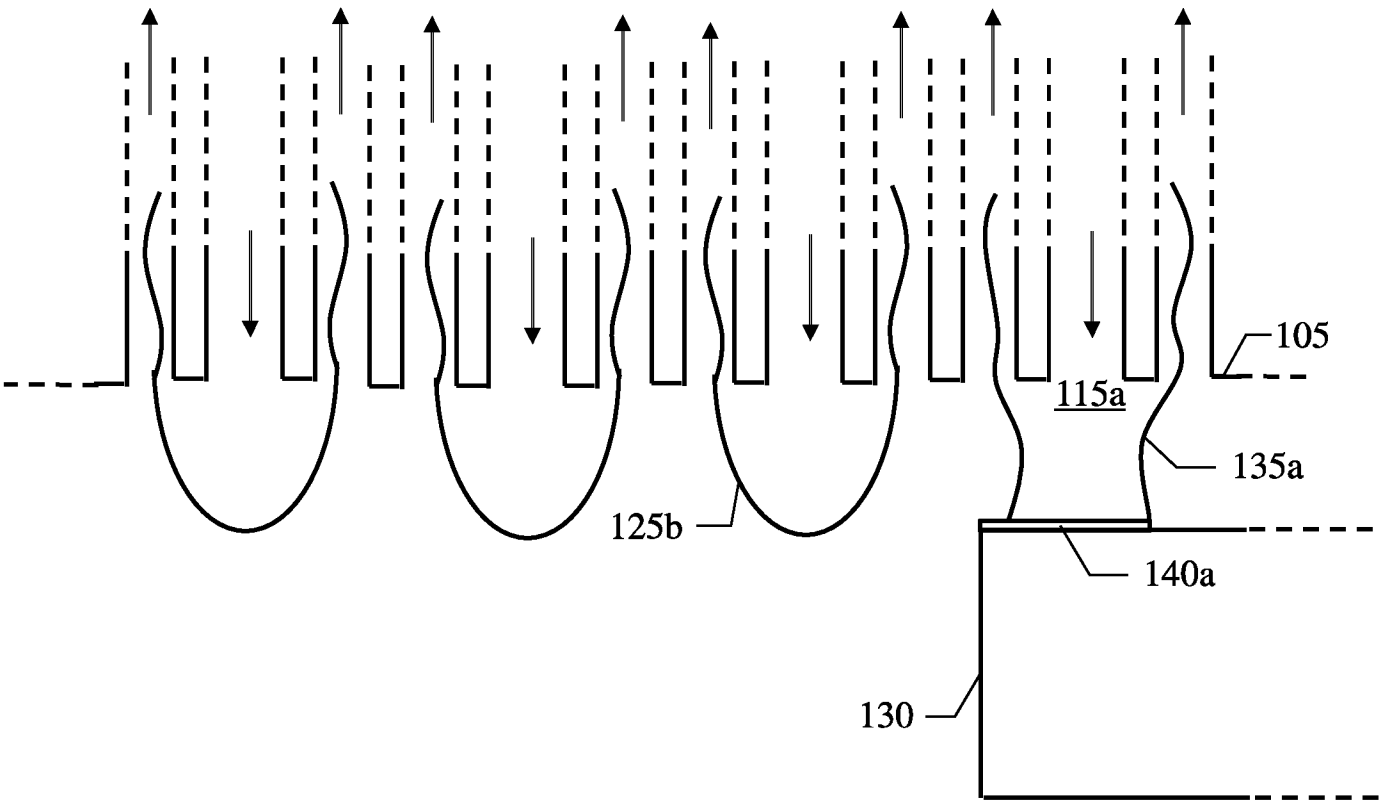

As soon as the substrate 130 reaches the (first) dynamic drop 125*a*, as shown in FIG. 1B, it transforms into a corresponding dynamic meniscus, denoted with the reference 135*a*, between the operative surface 105 and the substrate 130. Accordingly, the corresponding deposition current Ia which is applied to the galvanic solution 115*a* flows therefrom through the dynamic meniscus 135*a* towards the substrate 130 (for example, by applying a positive bias voltage to the galvanic solution 115*a* and a negative bias voltage to the substrate 130). A galvanic cell is so defined by the deposition head 100 (which acts as anode) and the substrate 130 (which acts as cathode). In this way, a layer 140*a* of the component Ca (of the multi-component structure) is deposited galvanically onto a region of the substrate 130 in contact with the dynamic meniscus 135*a* (which supplies the component Ca that is refreshed continuously by the flow of the galvanic solution 115*a*).

Figure 1C:
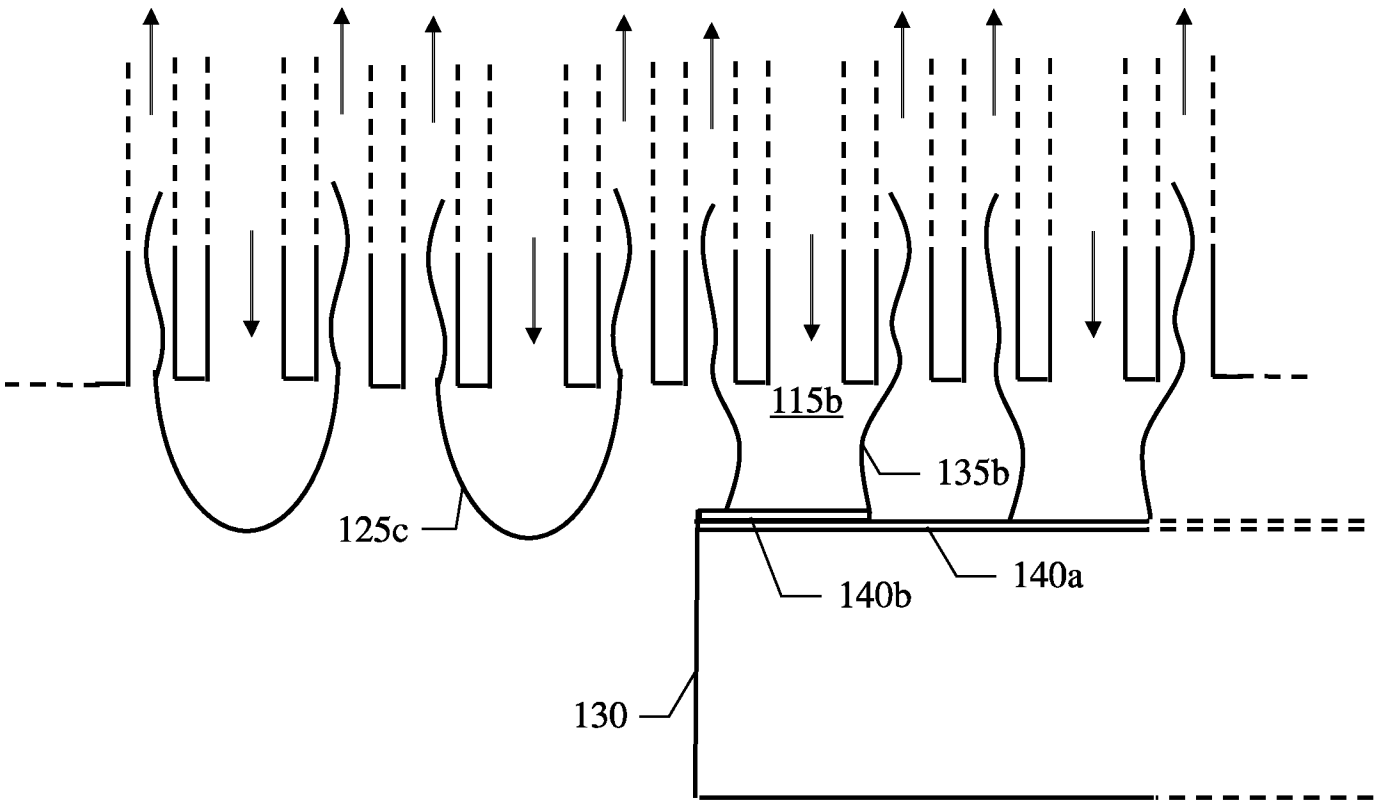

As soon as the substrate 130 (with the layer 140*a*) reaches the (second) dynamic drop 125*b*, as shown in FIG. 1C, as above it transforms into a corresponding dynamic meniscus, denoted with the reference 135*b*; the corresponding deposition current Ib (which flows from the galvanic solution 115*b* through the dynamic meniscus 135*b* and the layer 140*a* towards the substrate 130, for example, by applying a further positive bias voltage to the galvanic solution 115*b*) galvanically deposits a layer 140*b* of the component layer Cb (of the multi-component structure) onto a region of the layer 140*a* in contact with the dynamic meniscus 135*b*.

Figure 1D:
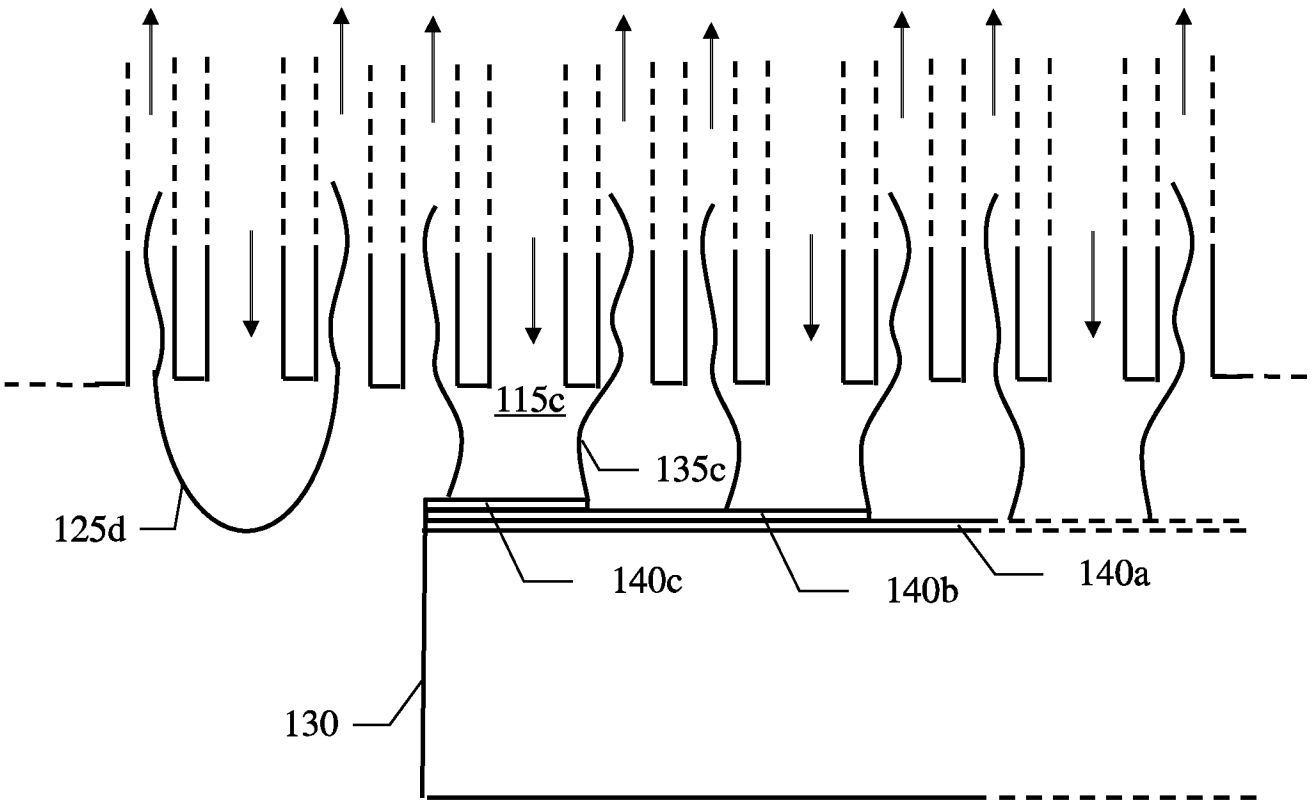

As soon as the substrate 130 (with the layers 140*a* and 140*b*) reaches the (third) dynamic drop 125*c*, as shown in FIG. 1D, as above it transforms into a corresponding dynamic meniscus, denoted with the reference 135*c*; the corresponding deposition current k (which flows from the galvanic solution 115*c* through the dynamic meniscus 135*c*, the layer 140*b* and the layer 140*a* towards the substrate 130, for example, by applying a further positive bias voltage to the galvanic solution 115*c*) galvanically deposits a layer

140*c* of the component layer Cc (of the multi-component structure) onto a region of the layer 140*b* in contact with the dynamic meniscus 135*c*.

Figure 1E:
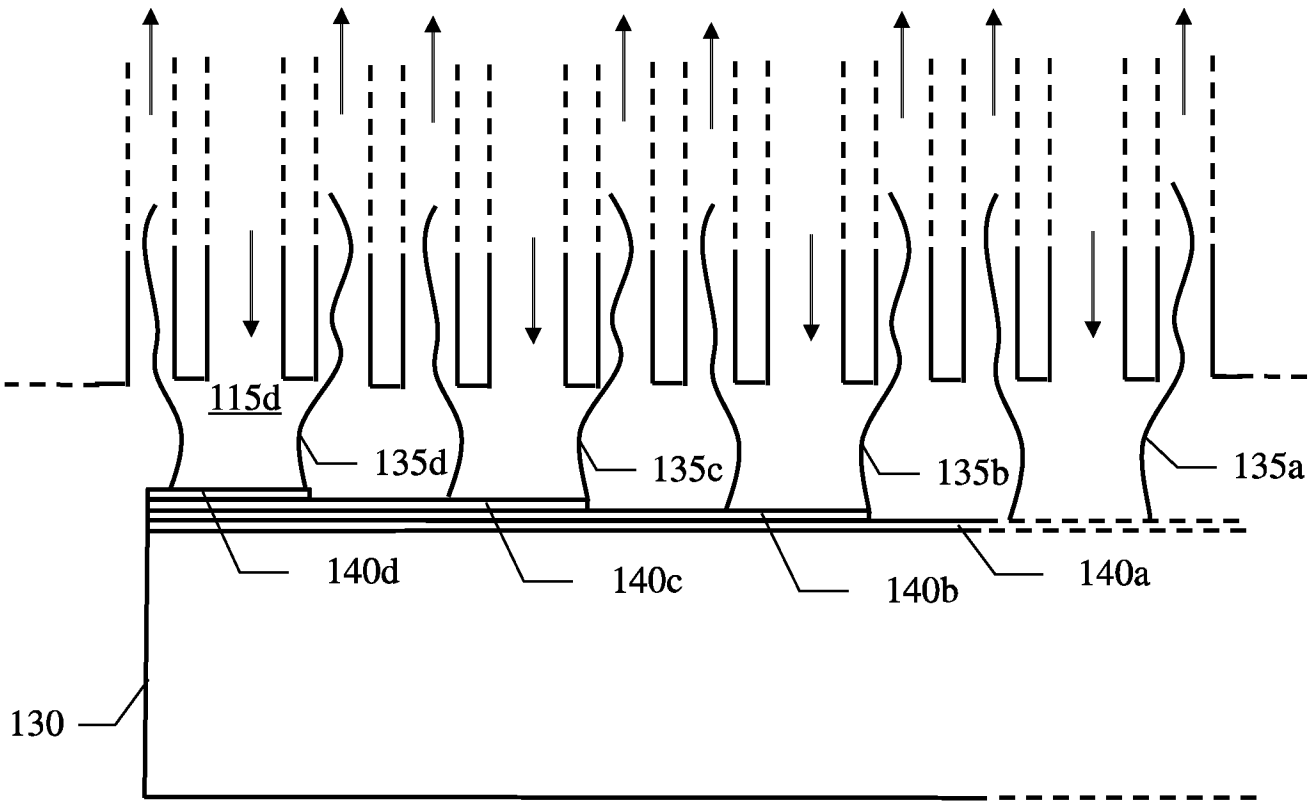

As soon as the substrate 130 (with the layers 140*a*, 140*b* and 140*c*) reaches the (fourth) dynamic drop 125*d*, as shown in FIG. 1E, as above it transforms into a corresponding dynamic meniscus, denoted with the reference 135*d*; the corresponding deposition current Id (which flows from the galvanic solution 115*d* through the dynamic meniscus 135*d*, the layer 140*c*, the layer 140*b* and the layer 140*a* towards the substrate 130, for example, by applying a further positive bias voltage to the galvanic solution 115*d*) galvanically deposits a layer 140*d* of the component layer Cd (of the multi-component structure) onto a region of the layer 140*c* in contact with the dynamic meniscus 135*d*.

Figure 1F:
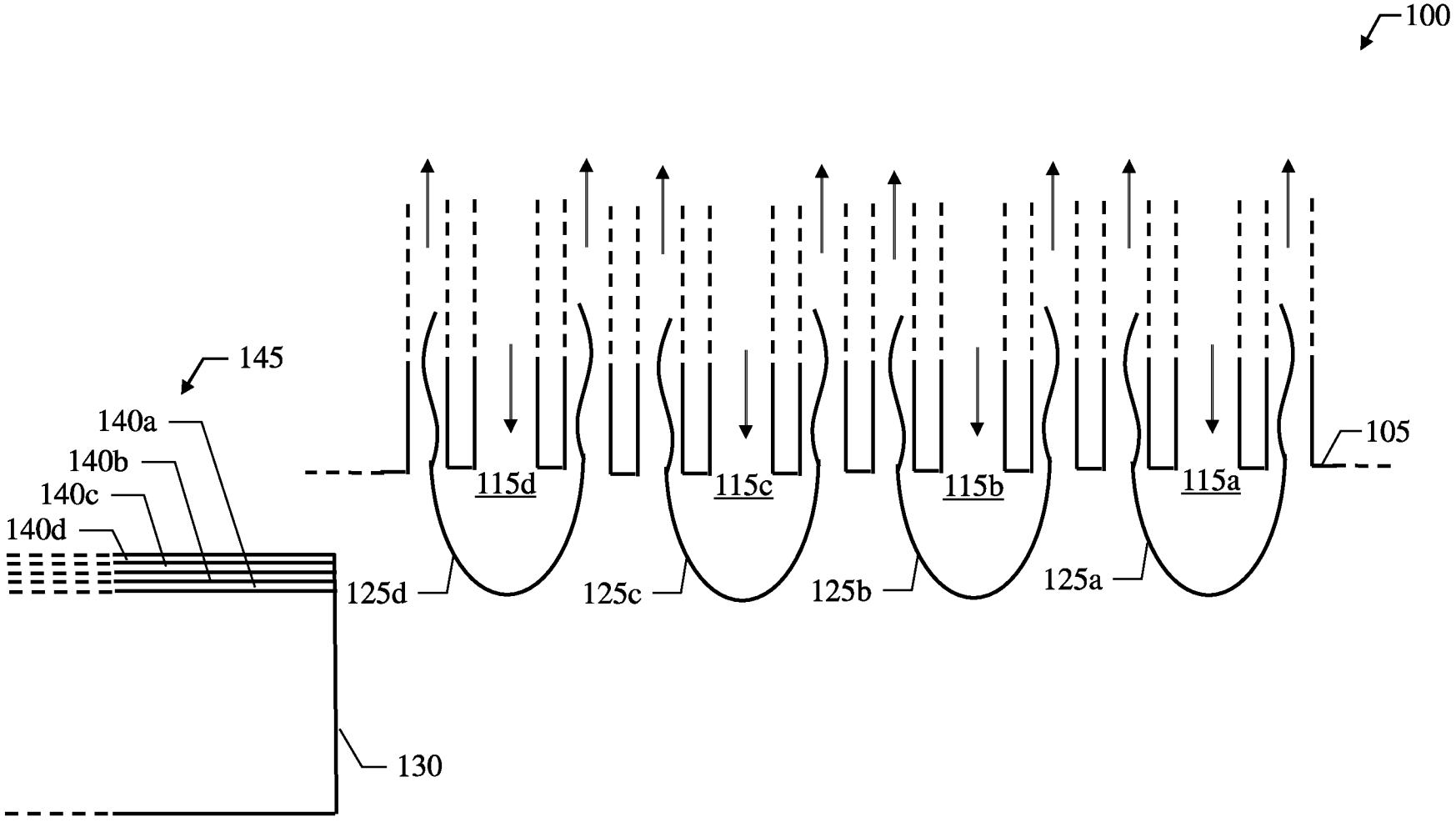

The galvanic deposition of the components Ca, Cb, Cc and Cd continues until the substrate 130 slides beyond the position of the dynamic menisci 135*a*, 135*b*, 135*c* and 135*d*, respectively, whereby they separate. As shown in FIG. 1F, at this point each dynamic meniscus returns the dynamic drop 125*a*-125*d* (attached on the operative surface 105 without any support). As a consequence, there is obtained the multi-component structure (or a part thereof), denoted with the reference 145; particularly, the multi-component structure 145 has a multi-layer construction, formed by the layers 140*a*, 140*b*, 140*c* and 140*d* stacked on each other on the substrate 130 (with the same procedure that may be reiterated one or more times to add any number of further layers, not shown in the figure).

The amount of each component Cj (with j=a–d) that is deposited is defined by the Faraday's law:

$$Dj = \frac{Ij \cdot Tj \cdot Mj}{Vj \cdot F}$$

wherein Dj[g] is the deposited amount, Ij[A] is the deposition current, Tj[s] is a deposition time, Mj[g/mol] and Vj[g/mo] are the molar mass and the valence number, respectively, of the component Cj and F is the Faraday's constant (F=96485.3365 C/mol). In order to make a multi-component structure with desired size and then mass, the total deposited amount Dj of each component Cj is calculated according to its (predetermined) percentage in the multi-component structure. Chosen the thicknesses of the layers 140*j* (the thinnest possible) in the multi-component structure (and then the number of passages of the substrate 130 through the deposition head 100 that deposits them), it is possible to calculate the deposited amount Dj of each component Cj for each passage according to the size of the dynamic meniscus, in turn determined by the (predetermined) size of the dynamic drop 125*j*. The deposition time Tj for each passage is defined by the time in which the region of the substrate 130 remains in contact with the dynamic meniscus during the sliding of the substrate 130 under the deposition head 100, so that it is equal to a (predetermined) width the dynamic meniscus, along a sliding direction of the substrate 130 parallel to the operative surface 105, divided by a sliding speed S of the substrate 130 with respect to the deposition head 100. Choosing the sliding speed S (the highest possible), it is possible to calculate the deposition current Ij of each component Cj (being the parameters Mj, Vj determined in a fixed manner by the component Cj). As a further improvement, it is also possible to take into account a deposition efficiency of each component Cj (determined a priori), thereby increasing the corresponding deposition current Ij. For example, a solder alloy SAC305 (96.5% tin, 3.0% silver and 0.5% copper by weight) has been deposited. For this purpose, considering a deposition efficiency of the tin of 91%, there have been used (with dynamic drops 125*a*-125*d* of 1 $cm^2$) a deposition current Ia=0.22+9%=0.24 A for the tin, a deposition current Ib=0.1 A for the silver and a deposition current Ic=0.36 A for the copper (while the deposition current Id has been maintained null). The (homogeneous) multi-component structure thus obtained has exhibited a composition (by weight) of mean value 96.48% for the tin (with standard deviation 0.22), 30.01% for the silver (with standard deviation 0.19) and 0.51% for the copper (with standard deviation 0.05), thus substantially equal to the expected values (apart from negligible differences in practice) in a highly repetitive manner.

The solution described above allows making multi-component structures in a very simple and effective way.

Particularly, this allows making multi-component structures of any size (by controlling the size of the dynamic drops 125*j* and then of the dynamic menisci accordingly), even at the micrometric level.

This result may be obtained using mono-component galvanic solutions 115*j*, which are stable and cheap.

Moreover, the various layers of each multi-component structure are deposited in rapid succession among them (during the relative movement of the substrate 130 and the deposition head 100). Therefore, it is possible to make the multi-component structure in a short time with a very high number of layers (for example, a few hundred) and then very thin; for example, each layer may have a thickness of 0.01-5.00 μm, preferably 0.05-1.00 μm, and still more preferably 0.08-0.80 μm, such as 0.1 μm. In this way, the components of the various layers self-diffuse thereby mixing among them; this allows obtaining a high homogeneity of the multi-component structure, even without any thermal reflow process (whose execution is however not excluded).

The multi-component structures may be made with a very high yield, and thus with reduced production costs. Indeed, the galvanic solutions 115*j* may be delivered (and removed) with a very high speed, for example, between 0.1 and 10.0 m/s, preferably 0.2 and 8.0 m/s and still more preferably between 0.4 and 2.0 m/s (such as 1.0 m/s). This provides a high replacement of the galvanic solutions 115*a*-115*d*, and then a high availability of the corresponding components Cj to be deposited onto the substrate 130 (making a sort of localized jet-plating). In this way, it is possible to increase the deposition currents Ij without adversely affecting the deposition efficiency of the corresponding components Cj. Therefore, given the desired thickness of the layers, and then the amount Dj to be deposited of the components, according to the formula set forth before the sliding speed S of the substrate increases (for example, with values of the order of 0.1-1.0 m/s), and then decreases the deposition time Tj. For example, in this way it is possible to achieve deposition rates of the order of several μm/s.

In addition, it is possible to feed the deposition solutions 115*j* continuously to the operative surface 105 while different substrates 130 are fed in succession to the deposition head 100 (since the dynamic drops 125*j* are formed independently of their presence). This reduces the dead time between the processing of the substrates 130 to a minimum and therefore it allows obtaining a very high yield in a batch production.

The solution described above may be used in several applications.

For example, in the field of electronics it is possible to make interconnection elements of electronic devices (where they may be contacted mechanically and electrically to implement their input/output functions). The interconnection elements may be of BGA or "copper pillar" type (in micro-electronic applications, such as for electronic devices of "flip-chip" type); in this case, the solution described above is used to make multi-component structures consisting of balls of solder alloy (deposited on pads of copper of interconnection elements of the BGA type) or caps of solder alloy (deposited on pillars of copper of interconnection elements of "copper pillar" type). Indeed, in this way it is possible to make multi-component structures (balls/caps) with the desired sizes (for example, diameter of 20.0-60.0 μm and pitch of 20.0-100.0 μm) of any solder alloy (for example, a SAC solder alloy with the addition of manganese, zinc, cobalt, nickel, aluminum, germanium, silicon or antimony in small amounts) in a simple and effective way.

As another example, in the field of chemistry it is possible to make a chrome plating of metallic objects to protect them from corrosion. In this case, the solution described above is used to deposit a layer of nickel on each metallic object and then a layer of chromium on the nickel layer (with the same operation that may be repeated one or more times). This greatly improves the corrosion resistance of the chrome plating, since the nickel layer prevents (or at least considerably hinders) corrosive substances to reach the metal object through micro-cracks in the layer of chromium (with the corrosion resistance that increases as the number of layers increases).

With reference now to FIG. 2*a*-FIG. 2F, FIG. 3A-FIG. 3C, FIG. 4A-FIG. 4C and FIG. 5A-FIG. 5D, different examples as shown of application of the solution according to an embodiment of the present invention.

Particularly, FIG. 2A-FIG. 2F relate to the deposition of one or more multi-component structures on corresponding bases.

Figure 2B:
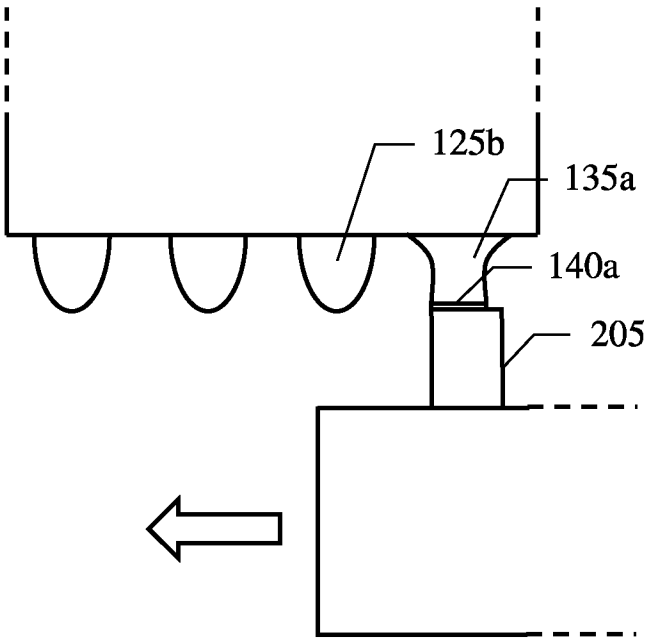
FIG. 2A-FIG. 2F, FIG. 3A-FIG. 3C, 4A-FIG. 4C and FIG. 5A-FIG. 5D show different examples of application of the solution according to an embodiment of the present invention.
Figure 2A:
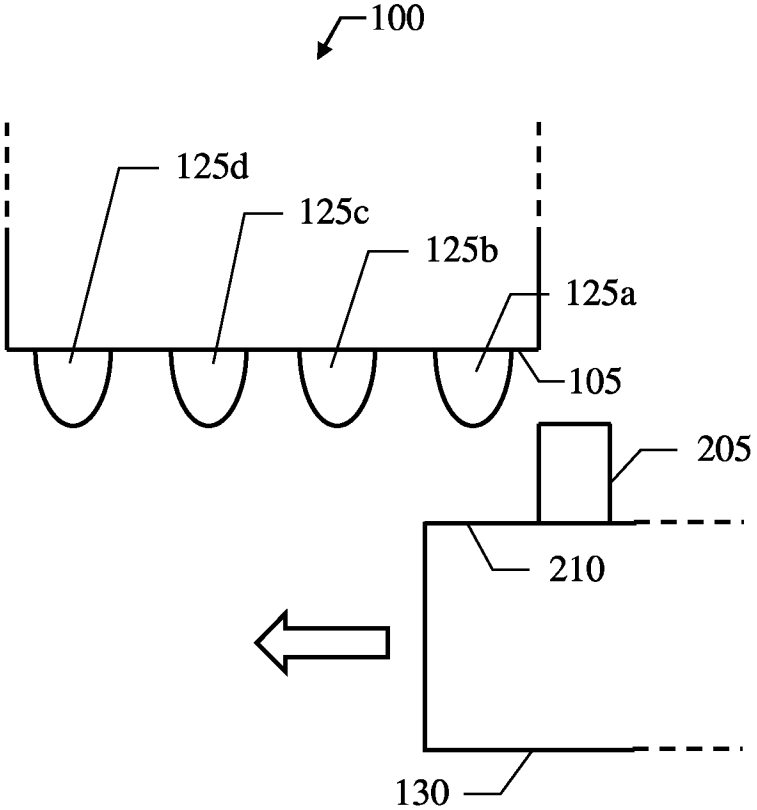

Starting from FIG. 2A, each base 205 (only one shown in the figure) protrudes from a main surface 210 of the substrate 130; for example, the base 205 is a pad of copper (of an interconnection element of the BGA type) or a pillar of copper (of an interconnection element of the "copper pillar" type) in a chip of semiconductor material. Initially, the substrate 130 is at the side of the deposition head 100, along a direction of their mutual sliding parallel to the main surface 105 (horizontally in the figure). The substrate 130 is spaced away from the deposition head 100, transversely to the sliding direction (vertically in the figure), so that a height of the dynamic drops 125*a*-125*d* is lower than a distance between the main surface 210 and the operative surface 105 but higher than a distance between the base 205 (top) and the operative surface 105. The substrate 130 slides with respect the deposition head 100 along the sliding direction in a first way (from the right to the left in the figure). Therefore, even when the substrate 130 reaches the dynamic drop 125*a*, the operative surface 105 remains separated from the dynamic drop 125*a*.

As soon as the dynamic drop 125*a* is reached from the base 205, as shown in FIG. 2B, instead it transforms into the dynamic meniscus 135*a* that deposits the layer 140*a* of the component Ca onto the base 205.

Figure 2D:
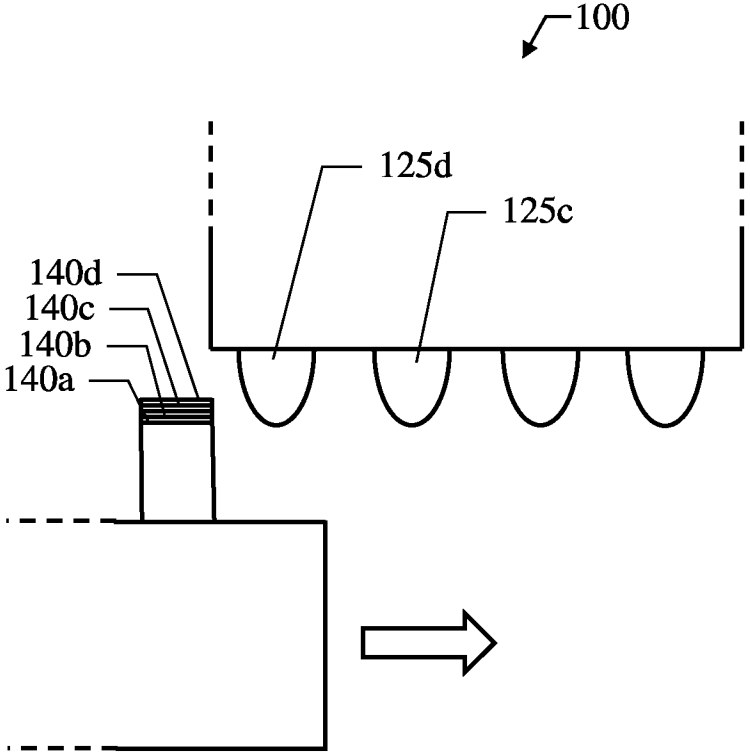
Figure 2C:
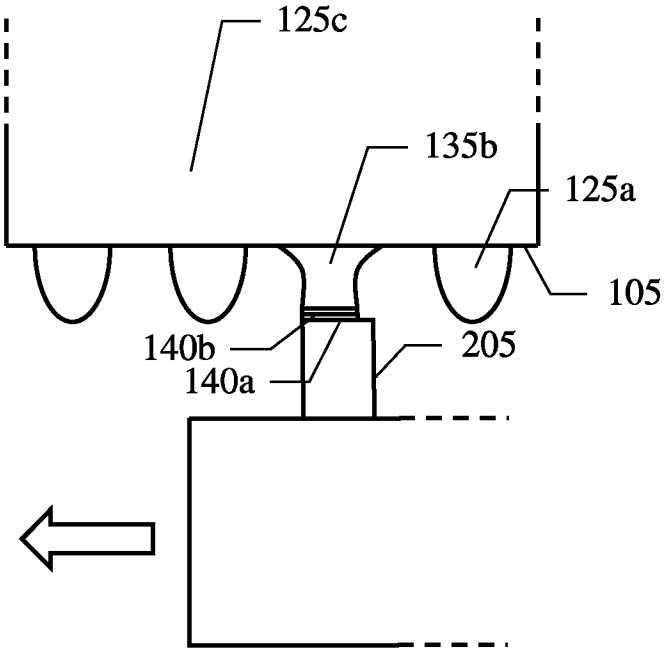

As soon as the base 205 reaches the next dynamic drop 125*b*, as shown in FIG. 2C, it transforms into the dynamic meniscus 135*b* that deposits the layer 140*b* of the component Cb onto the layer 140*a*. Meanwhile, as soon as the base 205 passes the previous dynamic meniscus, the latter returns the corresponding dynamic drop 125*a* that remains separated from the operative surface 105.

Passing to FIG. 2D, the process proceeds in a similar manner with the dynamic meniscus corresponding to the dynamic drop 125*c* that deposits the layer 140*c* of the component Cc onto the layer 140*b* (above the layer 140*a*) and the dynamic meniscus corresponding to the dynamic drop 125*d* that deposits the layer 140*d* of the component Cd onto the layer 140*c*.

Figure 2F:
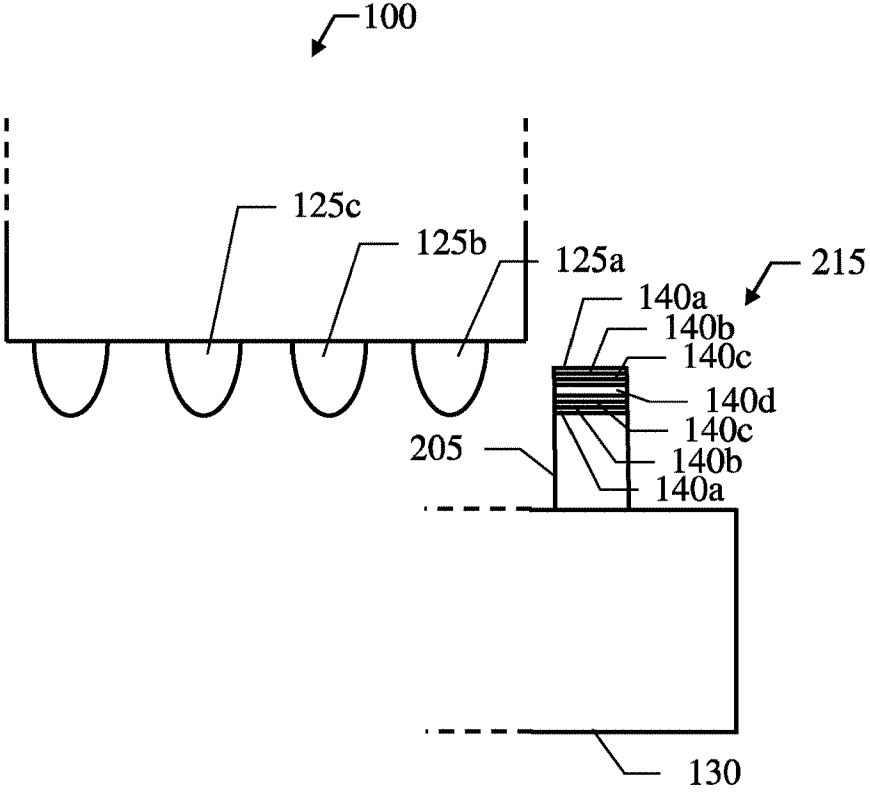
Figure 2E:
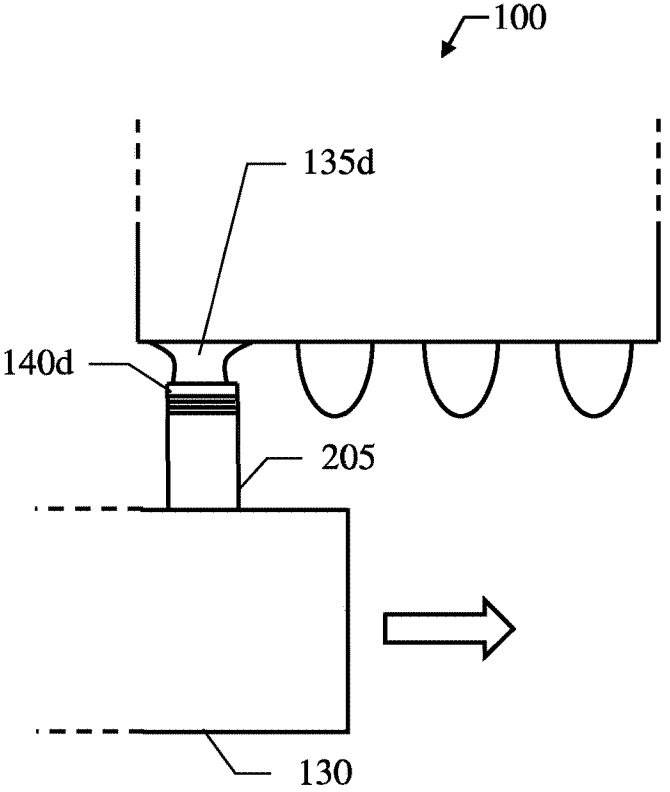

Passing to FIG. 2E, at this point the substrate 130 slides with respect to the deposition head 100 along the sliding direction in a second way opposite the previous one (from the left to the right in the figure). Therefore, the dynamic meniscus 135*d* (already present if the base 205 had not passed it or formed by the corresponding dynamic drop as soon as reached by the base 205 otherwise) deposits further component Cd onto the layer 140*d* (increasing its thickness).

Passing to FIG. 2F, the process proceeds in a similar manner with the dynamic meniscus corresponding to the dynamic drop 125*c* that deposits another layer 140*c* of the component Cc onto the (thicker) layer 140*d*, the dynamic meniscus corresponding to the dynamic drop 125*b* that deposits another layer 140*b* of the component Cb onto the layer 140*c* and the dynamic meniscus corresponding to the dynamic drop 125*a* that deposits another layer 140*a* of the component Ca onto the layer 140*b*. As a consequence, there is obtained a multi-component structure (or a portion thereof) 215 (for example, the ball of solder alloy of the interconnection element of the BGA type or the cap of solder alloy of the interconnection element of the "copper pillar" type), which comprises the layers 140*a*, 140*b*, 140*c* and 140*d* of the components Ca, Cb, Cc and Cd, respectively, stacked on each other (in reverse order) onto the (double) layer of the component Cd (with the same procedure that may be reiterated one or more times to add any number of additional layers, not shown in the figure).

This allows obtaining the multi-component structures in a very fast way (due to the continuous sliding of the substrate 130 back and forth). The different order of the layers of each multi-component structure does not create any problem in practice, since the corresponding components mix up in any case thanks to the reduced thickness of the layers.

Figure 3B:
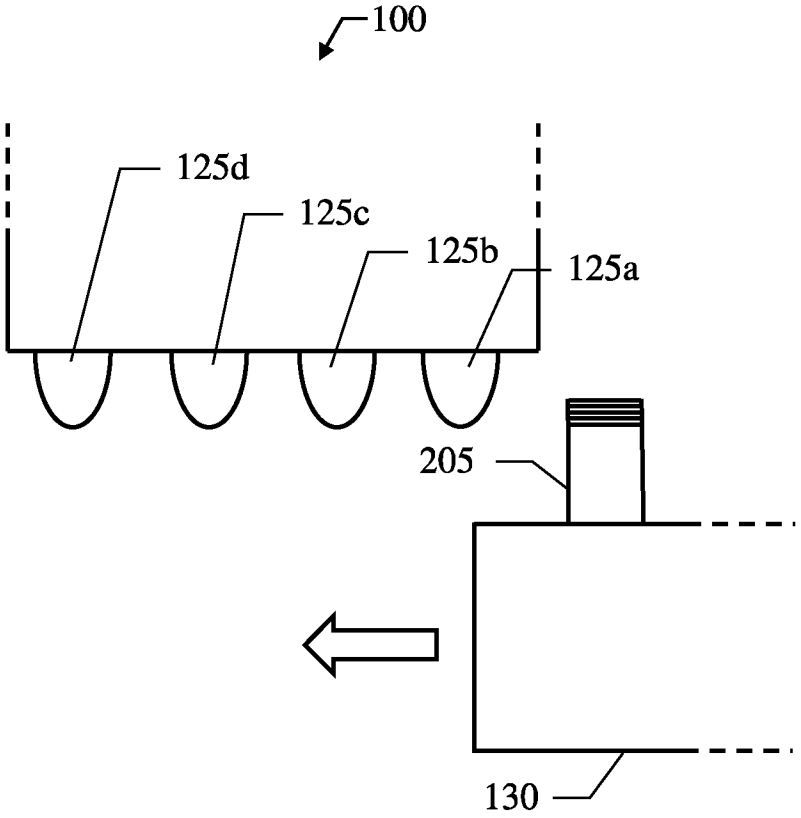
Figure 3A:
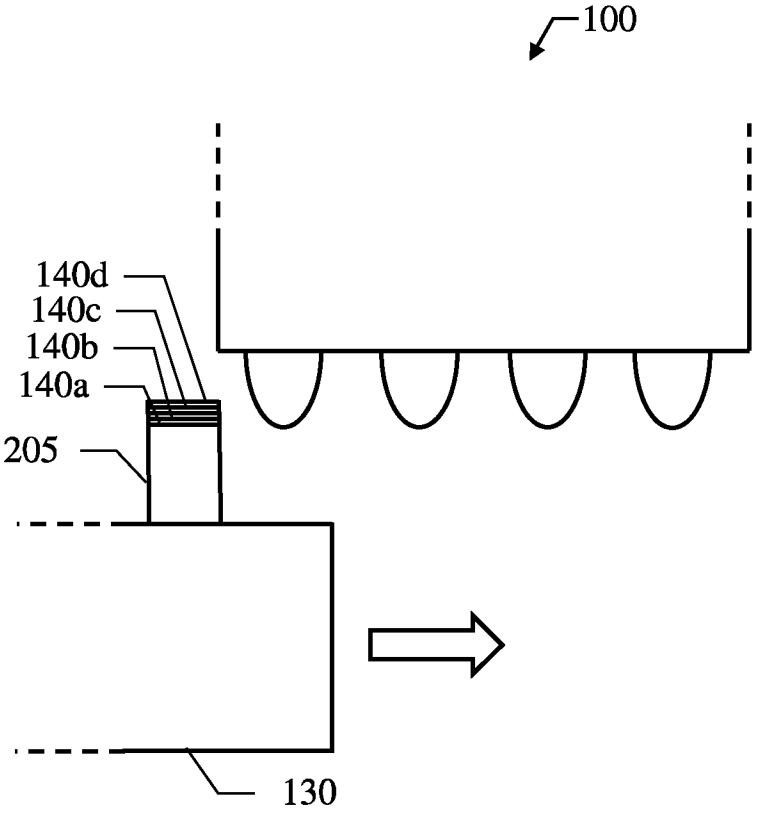
Figure 3C:
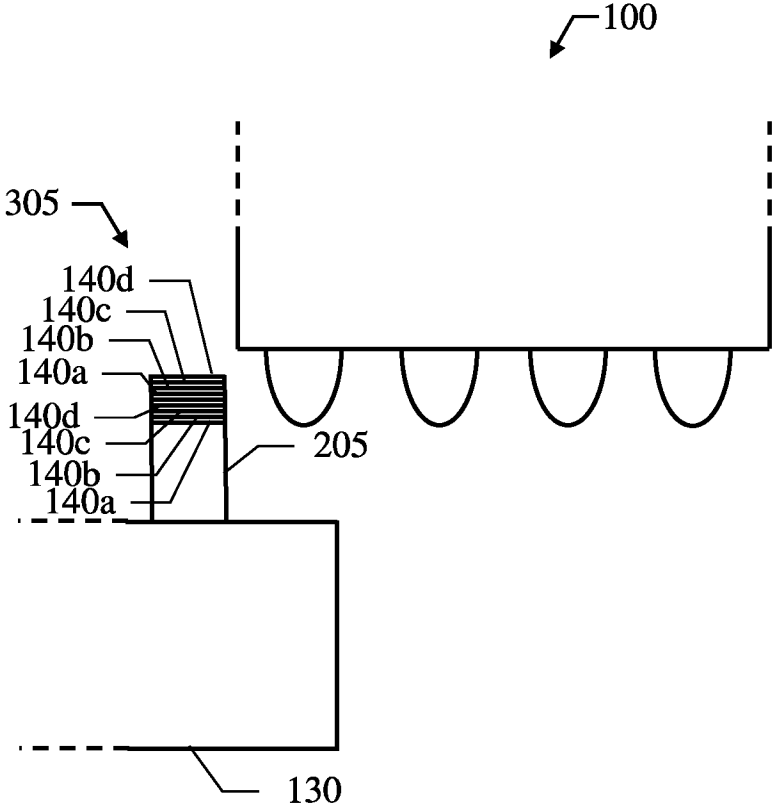

FIG. 3A-FIG. 3C relate to an alternative mode of deposition of similar multi-component structures on the same bases.

Starting from the FIG. 3A, the layers 140*a*, 140*b*, 140*c* and 140*d* (of the components Ca, Cb, Cc and Cd, respectively) stacked on each other on the base 205 are deposited as described above, while the substrate 130 slides with respect to the deposition head 100 along the sliding direction in the first way (from the right to the left).

Passing to the FIG. 3B, at this point the application of the deposition currents and/or the delivering of the deposition solutions is stopped for all the components Ca-Cd. As above, the substrate 130 slides with respect to the deposition head 100 along the sliding direction in the second way (from the left to the right). Therefore, when the delivering of the deposition solution is stopped (not shown in the figure) the corresponding dynamic drops are not created and/or when the application of the deposition current is stopped (as shown in the figure) even when the base 205 reaches each dynamic drop 125*a*-125*d* the corresponding dynamic meniscus does not deposit the component Ca-Cd galvanically. The substrate 130 then remains unchanged.

Passing to FIG. 3C, the substrate 130 slides again with respect to the deposition head 100 along the sliding direction in the first way (from the right to the left). Therefore, further layers 140*a*, 140*b*, 140*c* and 140*d* (of the same components Ca, Cb, Cc and Cd, respectively) stacked on each other are deposited as above onto the previous layer 140*d*. As a consequence, there is obtained a multi-component structure (or a portion thereof) 305, which comprises the layers 140*a*, 140*b*, 140*c* and 140*d* of the components Ca, Cb, Cc and Cd, respectively, stacked on each other on the base 205 and the layers 140*a*, 140*b*, 140*c* and 140*a* of the same components Ca, Cb and Ca, respectively, stacked on each other (in the same order) onto them (with the same procedure that may be reiterated one or more times to add any number of further layers, not shown in the figure).

This allows obtaining multi-component structures with the corresponding layers arranged in a uniform manner (with a speed halved compared to the previous case, because of the time not used during the sliding in the second way, which speed however remains enough high). This result may be obtained by stopping the delivering of the deposition solutions (in order to avoid any kind of deposition of the corresponding components). In addition or in alternative, the same result may be obtained by stopping the application of the deposition currents (in a simple and fast way without any need to resume the delivering of the deposition solutions); in this case, any deposits of the corresponding components even in the absence of current (such as silver onto tin) occur with a very low deposit rate (of the order of a few nm per hour) so that they are negligible in practice.

Figure 4B:
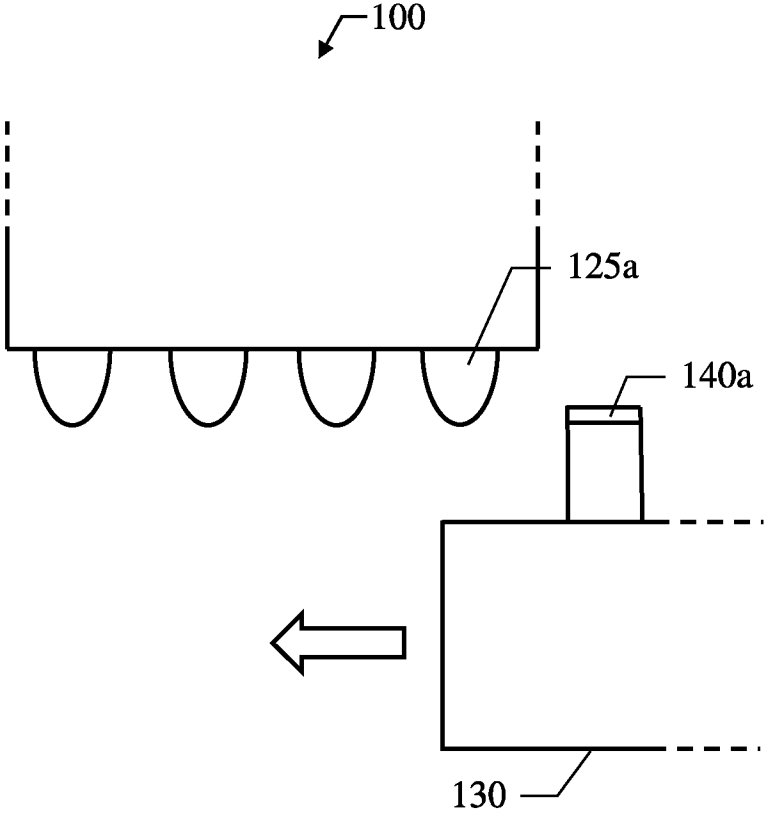
Figure 4A:
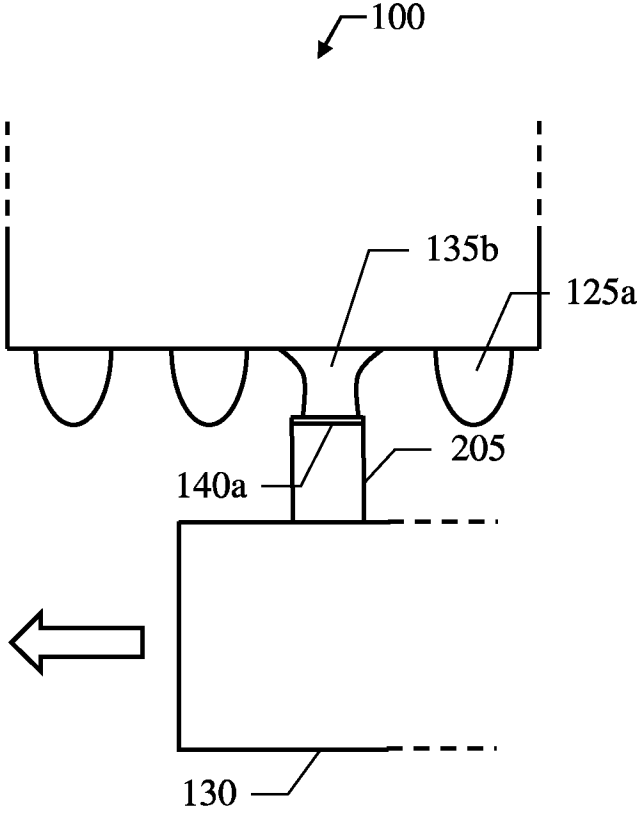
Figure 4C:
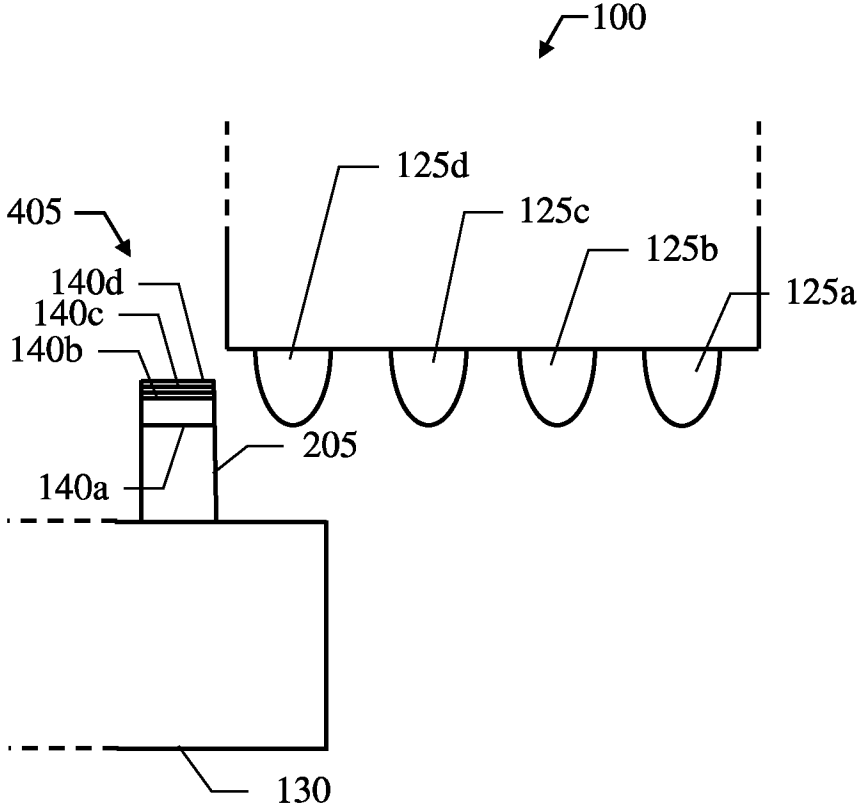

FIG. 4A-FIG. 4C relate to the deposition of multi-component structures with differentiated configuration onto the same bases.

Starting from FIG. 4A, the application of the deposition currents and/or the delivering of the deposition solutions is stopped for the components different from a selected one (for example, the component Ca). Therefore, while the substrate 130 slides with respect to the deposition head 100 along the sliding direction in the first way (from the right to the left), only the layer 140*a* of the component Ca is deposited onto the base 205 (by the dynamic meniscus corresponding to the dynamic drop 125*a*); conversely, when the delivering of the deposition solutions is stopped (not shown in the figure) the other dynamic drops are not created and/or when the application of the deposition currents is stopped even when the base 205 reaches every other dynamic drop the corresponding dynamic meniscus does not deposit the component Cb-Cd galvanically (as shown in the figure for the meniscus 135*b*).

Passing to FIG. 4B, likewise while the substrate 130 slides with respect to the deposition head 100 along the sliding direction in the second way (from the left to the right), only further component Ca is deposited onto the layer 140*a* (increasing its thickness) by the dynamic meniscus corresponding to the dynamic drop 125*a*; the same procedure may be reiterated one or more times (not shown in the figures) to add further component Ca until the corresponding layer reaches the desired thickness.

Passing to FIG. 4C, at this point the application of the deposition currents and/or the delivering of the deposition solutions is resumed for the other components Cb, Cc and Cd as well. Therefore, further component Ca is deposited onto the layer 140*a* (further increasing the thickness) by the dynamic meniscus corresponding to the dynamic drop 125*a* and the layers 140*b*, 140*c* and 140*d* (of the components Cb, Cc and Cd, respectively) stacked on each other onto the layer 140*a* are deposited as above by the dynamic menisci corresponding to the dynamic drops 125*b*, 125*c* and 125*d*, respectively, while the substrate 130 slides with respect to the deposition head 100 along the sliding direction in the first way (from the right to the left). As a consequence, there is obtained a multi-component structure (or a portion thereof) 405 (for example, an interconnection element of the "copper pillar" type), which comprises the layers 140*b*, 140*c* and 140*d* of the components Cb, Cc and Cd, respectively (which make the cap of solder alloy, with the same procedure that may be reiterated one or more times to add any number of further layers, not shown in the figure), stacked on each other onto the layer 140*a* of the component Ca (onto the base 205) with a thickness higher at will (which makes the copper pillar).

Similar considerations apply by stopping the application of the deposition currents and/or the delivering of the deposition solutions for any number of components in any order.

This makes the solution described above very flexible, since it allows obtaining multi-component structures with any desired configuration.

FIG. 5A-FIG. 5D relate to the deposition of multi-component structures onto selected areas of the substrates.

Figure 5B:
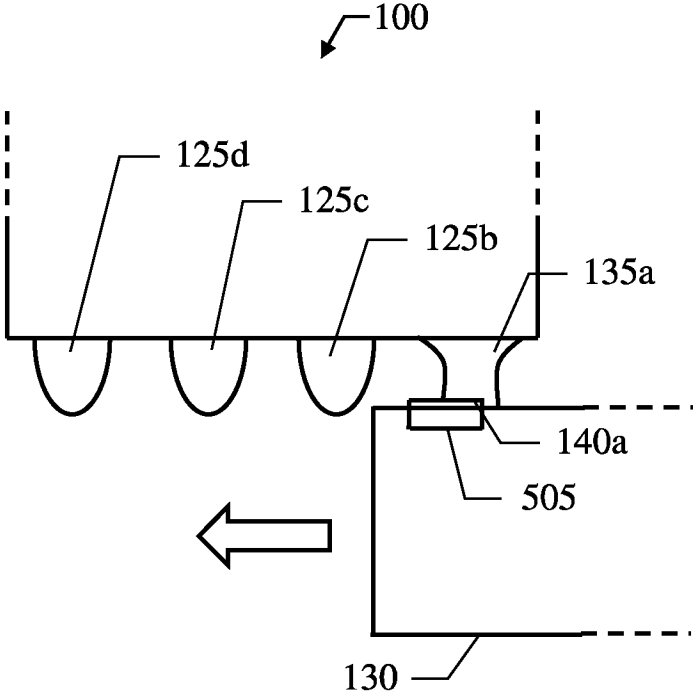
Figure 5A:
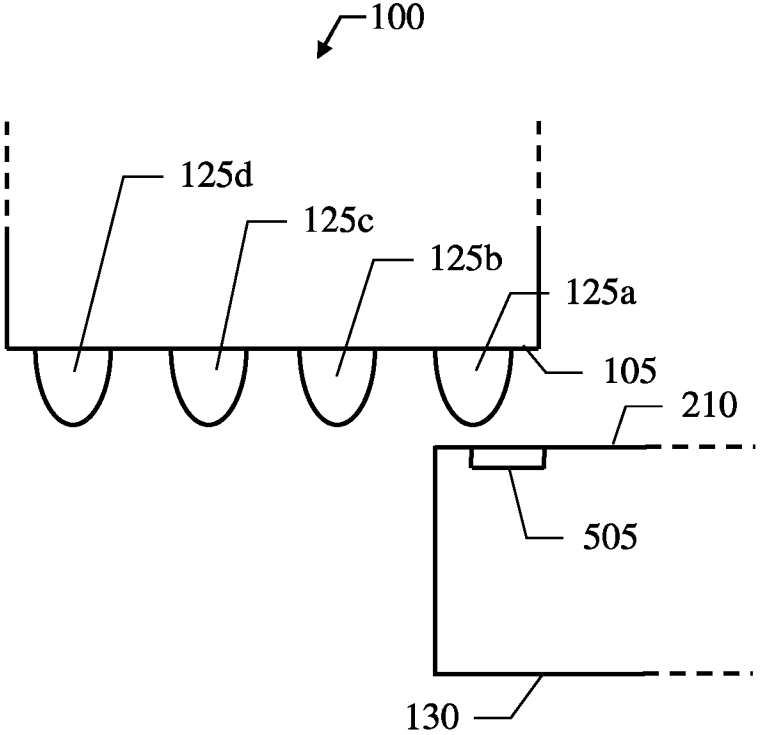

Starting from FIG. 5A, for example, the substrate 130 has a substantially planar configuration (defined by the main surface 210); the multi-component structure (not shown in the figure) has to be made in each (selected) area 505 of the main surface 210 (only one is shown in the figure). Initially, the substrate 130 is at the side of the deposition head 100 along their direction of mutual sliding, spaced apart from the deposition head 100 transversely to the sliding direction so that the distance between the main surface 210 and the operative surface 105 is higher than the height of the dynamic drops 125*a*-125*d*. The substrate 130 slides with respect to the deposition head 100 along the sliding direction in the first way (from the right to the left), until the substrate 130 is brought with the beginning of selected area 505 at the (first) dynamic drop 125*a*, remaining however spaced apart from it.

At this point, the substrate 130 and the deposition head 100 get nearer to each other transversely to the sliding direction (for example, by raising the substrate 130) up to when the substrate 130 reaches the dynamic drop 125. Therefore, as shown in FIG. 5B, this dynamic drop transforms into the corresponding dynamic meniscus 135*a*. The application of the deposition current and the delivering of the deposition solution current is maintained only for the component Ca (dynamic meniscus 135*a*), while one or both of them are stopped for the other components Cb, Cc, and Cd (dynamic drops 125*b*, 125*c* and 125*d*, respectively). At this point, the substrate 130 slides with respect to the deposition head 100 along the sliding direction in the first way (from the right to the left). The application of the deposition current and the delivering of the deposition solution for the component Ca are maintained for a time corresponding to an extent of the selected area 505 along the sliding direction (equal to it divided by the sliding speed), whereupon the application of the deposition current and/or the delivering of the deposition solution for the component Ca is stopped. Therefore, the dynamic meniscus 135*a* deposits the layer 140*a* of the component Ca only onto the selected areas 505.

Meanwhile, after a time corresponding to a distance from the dynamic drop corresponding to the dynamic meniscus 135*a* to the (next) dynamic drop 125*b* (equal to it divided by the sliding speed), the application of the deposition current and the delivering of the deposition solution for the component Cb are resumed. As soon as the substrate 130 during its sliding with respect to the deposition head 100 reaches the dynamic drop 125*b*, as shown in FIG. 5C, it transforms into the dynamic meniscus 135*b*. As above, the application of the deposition current and the delivering of the deposition solution for the component Cb are maintained for a time corresponding to the extent of the selected area 505 along the sliding direction (equal to it divided by the sliding speed), whereupon the application of the deposition current and/or the delivering of the deposition solution for the component Cb is stopped. Therefore, the dynamic meniscus 135*b* deposits the layer 140*b* of the component Cb only in the selected area 505, onto the layer 140*a*.

Figure 5D:
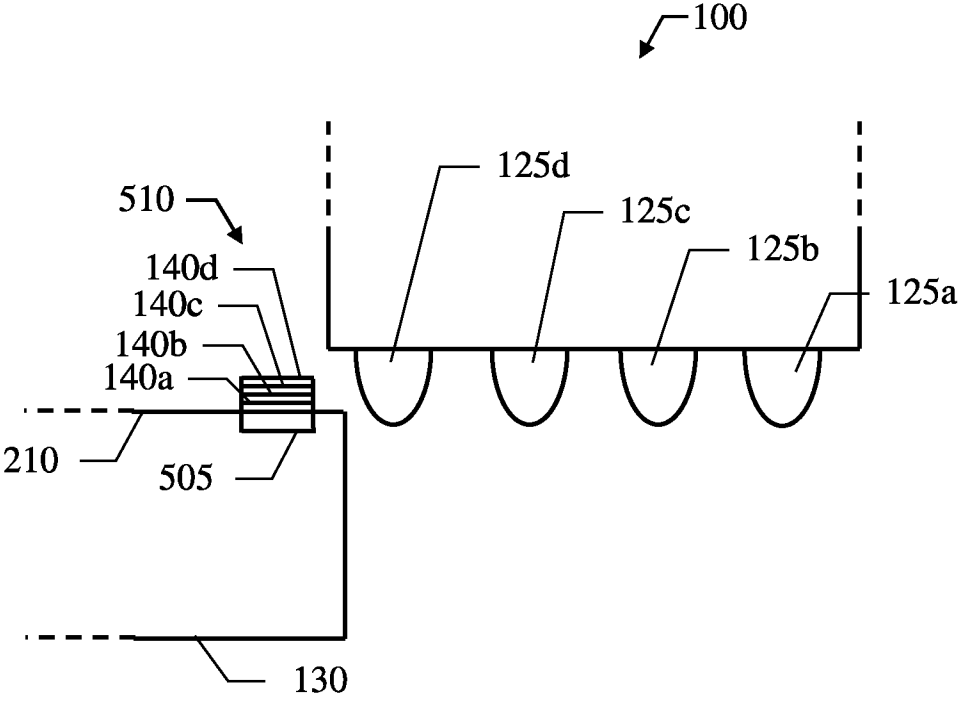
Figure 5C:
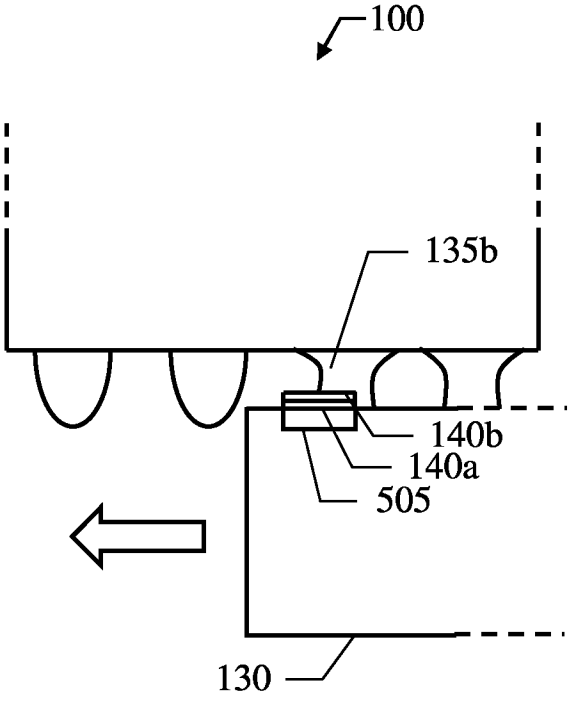

Passing to FIG. 5D, the process proceeds in a similar manner with the dynamic meniscus corresponding to the dynamic drop 125*c* that deposits the layer 140*c* of the component Cc only in the selected area 505 onto the layer 140*b* and with the dynamic meniscus corresponding to the dynamic drop 125*d* that deposits the layer 140*d* of the component Cd only in the selected area 505 onto the layer 140*c*. As a consequence, there is obtained a multi-component structure (or a part thereof) 510, which comprises the layers 140*a*, 140*b*, 140*c* and 140*d* of the components Ca, Cb, Cc and Cd, respectively, stacked on each other only onto the selected area 505 (similar considerations apply in the case wherein the selected areas correspond to bases slightly protruding from the main surface 210 so that it is nonetheless reached by the dynamic drops 125*a*-125*d* during the sliding of the substrate 130 with respect to the deposition head 100). Similar considerations apply to the deposition of multi-component structures with differentiated configuration onto the selected area 505 (by stopping as above the application of the deposition currents and/or the delivering of the deposition solutions). In addition, the process may proceed in a similar manner when the substrate 130 slides with respect to the deposition head 100 along the sliding direction in the second way (from the left to the right), either by maintaining or not the application of the deposition currents and the delivering of the deposition solutions as above (with the same procedure that may be reiterated one or more times to add any number of further layers, not shown in the figure)

This allows making multi-component structures in any desired position, without the need of using expensive masking techniques (for example, of photolithographic type), even if this operation is not excluded.

Figure 6:
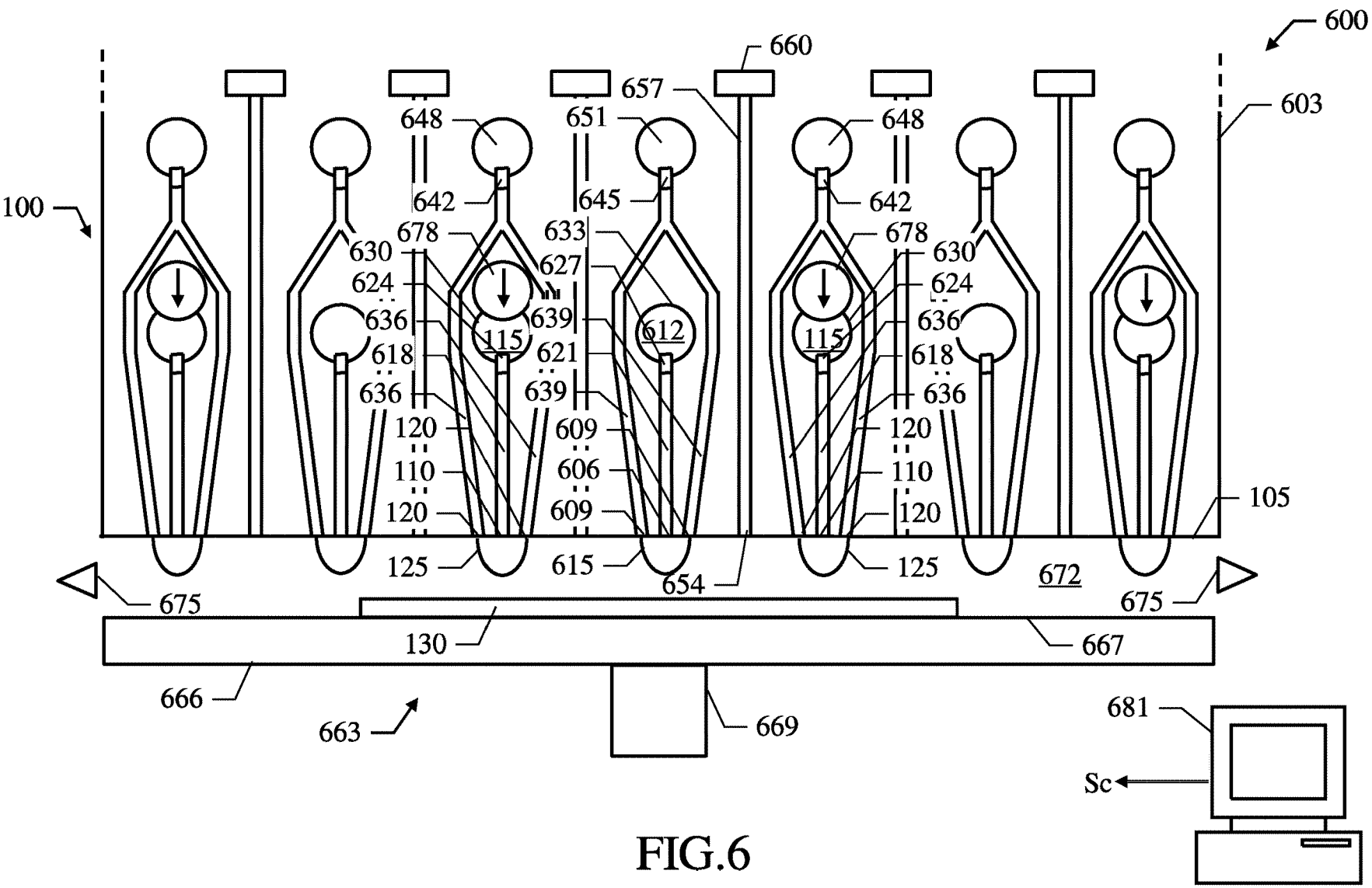
FIG. 6 shows a schematic representation in lateral cross-section of a deposition system according to an embodiment of the present invention.

With reference now to FIG. 6, a schematic representation is shown in lateral cross-section of a deposition system 600 according to an embodiment of the present invention.

The deposition system 600 comprises one or more deposition heads 100 (only one shown in the figure, with the respective components indicated only in part and by omitting the corresponding indexes).

La deposition head 100 comprises a main body 603 defining the operative surface 105 with the delivering ports 110 and the removing ports 120; for example, the main body 603 is a block of epoxy material, plastic material, glass, ceramics or silicon made by using 3D stereo-lithographic or micro-printing techniques leveraging a multiple photonic absorption, with a thickness of 50-5.000 μm).

The main body 603 may have a parallelepiped shape, possibly with a projecting flange at the operative surface 105. The delivering ports 110 may have an elongated shape (for example, with a width of 10-1.000 μm and a length of 500-4.500.000 μm). The removing ports 120 may have a frame shape (for example, with a thickness of 10-1.000 μm, a width of 5-500 μm and a length of 500-450.000 μm); each removing port 120 is arranged around the corresponding delivering port 110 so as to surround it completely (for example, at a distance of 1-500 μm). Therefore, the corresponding dynamic drop 125 will have an elongated shape as well (for example, with a width of 20-500 μm and a length of 0.5-450.0 mm).

Similar one or more (further) delivering ports 606 and similar one or more (further) removing ports 609 are open on the operative surface 105 as well; as above, for each delivering port 606, one (or more) removing port 609 is arranged around it (at least partly) on the operative surface 105. Each delivering port 606 and the corresponding removing port 609 are interposed between a pair of corresponding (delivering and removing) ports 110,120 and another pair of corresponding (delivering and removing) ports 110,120 adjacent to each other. The delivering ports 606 are used to deliver rinsing solutions 612 (for example, deionized water) and the removing ports 609 are used to remove the rinsing solutions 612 that have been delivered on the operative surface 105 (without substantially losing them by the deposition head 100). Accordingly, (further) dynamic drops 615 are formed at the delivering ports 606 (each formed by the rinsing solution 612 that remains attached on the operative surface 105, in a substantially fixed position but with a content thereof that is continuously refreshed by a flow of the rinsing solution 612 that flows from the delivering port 606 to the removing port 609).

The dynamic drops 615 eliminate (or at least substantially reduce) any risk of cross-contamination during the processing of the substrate 130. Indeed, during the relative sliding of the substrate 130 with respect to the deposition head 100, after the substrate has been brought into contact with the dynamic meniscus corresponding to each dynamic drop 125 (which has deposited the layer of the corresponding component Ca-Cd), it is brought into contact with a dynamic drop 615. Therefore, the rinsing solution 612 of the dynamic drop 615 rinses the layer of the component Ca-Cd before the substrate 130 is brought into contact with the dynamic meniscus corresponding to the (next) dynamic drop 125 that deposits the layer of a different component Ca-Cd.

Delivering ducts 618 and (further) delivering ducts 621 connect the delivering ports 110 and the delivering ports 606 to outlet pumps 624 and to (further) outlet pumps 627, respectively. In turn, the outlet pumps 624 and the outlet pumps 627 are connected to delivering tanks 630 of the galvanic solutions 115 and to (further) delivering tanks 633 of the rinsing solutions 612, respectively. Likewise, removing ducts 636 and (further) removing ducts 639 connect the removing ports 120 and the removing ports 609 to inlet pumps 642 and to (further) inlet pumps 645, respectively. In turn, the inlet pumps 642 and the inlet pumps 645 are connected to removing (collection and/or recirculation) tanks 648 of the galvanic solutions 115 and to (further) removing (collection and/or recirculation) tanks 651 of the rinsing solutions 612, respectively.

The delivering ducts 618,621 extend perpendicularly from the operative surface 115. The removing ducts 624, 627, instead, extend obliquely from the operative surface 115. Particularly, each delivering duct 618,621 and the corresponding removing duct 624,627 have an arrangement (at least in part) diverging moving away from the operative surface 115 (for example, forming between them an angle of 5-45°, preferably 10-35° and still more preferably 15-25°, such as 20°). As a consequence, it is possible to maintain each removing port 120,609 very close to the corresponding delivering port 110,606 (for example, at a distance up to 1-5 μm) for forming dynamic drops 125,615 accordingly very small. Nevertheless, the delivering ducts 618,621 and the removing ducts 624,627 may be sufficiently spaced away to each other in distal position from the operative surface 115.

This allows having a good rigidity of the main body 603 and having enough room for the connections to the ducts 618, 621, 624 and 627.

One or more forcing ports 654 are open on the operative surface 105. Each forcing port 654 is interposed between a pair of corresponding (delivering and removing) ports 110, 120 or 606,609 and another pair of corresponding (delivering and removing) ports 110,120 or 606,609 adjacent to each other. The forcing ports 654 are used to force an auxiliary fluid (for example, air) under pressure at the operative surface 105. As above, forcing ducts 657 (for example, extending perpendicularly to the operative surface 105) connect the forcing ports 654 to blowers 660 (for example, open towards the outside environment).

The deposition system 600 further comprises a conveyor 663 of one or more substrates 130 to be processed (only one shown in the figure). The conveyor 663 comprises a platform 666 for resting and holding in position (for example, with vacuum suction caps) the substrate 130. The platform 666 is mounted on a handler 669 (for example, of hydraulic type), which may slide the platform 666 both in parallel and transversely to the operative surface 105. When the platform 666 faces the deposition head 100, a cavity 672 is formed between them, i.e., between the operative surface 105 of the deposition head 100 and a restraining surface 667 of the platform (for example, with a thickness of 0.02 to 2.00 mm); in this way, the cavity 672 is formed by exploiting (at least in part) elements of the conveyor 663 otherwise present (for conveying the substrate 130). One or more blowers 675 are arranged at the side of the cavity 673 to force a (further) auxiliary fluid, for example, again air, under pressure towards it.

Power supplies 678 apply the deposition currents to the galvanic solutions 115; for example, the power supplies 678 are implemented by current sources that act, through corresponding supply terminals not shown in the figure, between the delivering tanks 630 and the platform 666 (so as to apply corresponding voltages between the galvanic solutions 115 and the substrate 130). A control device 681 (for example, an industrial PC) controls the operation of the deposition system 600 (via control signals, denoted as a whole with Sc). Particularly, the control device 681 commands (individually or cumulatively) the outlet pumps 624,627, the inlet pumps 642,645, the blowers 660,675 and the mover 669 and it controls individually the power suppliers 678.

In operation, each outlet pump 621,624 draws the (galvanic or rinsing) solution 115,612 from the delivering tank 624,627 and provides it, through the delivering duct 624, 627, to the delivering port 110,606*c* which delivers it into the cavity 672. At the same time, the blowers 675 force the auxiliary fluid laterally into the cavity 672; this allows forcing the auxiliary fluid freely, thanks to the relatively large room available between the operative surface 105 and the restraining surface 667. In addition or in alternative, each blower 660 forces the auxiliary fluid along the forcing duct 657 and then, through the forcing port 654, into the cavity 672 as well; this allows forcing the auxiliary fluid in an effective way at every point of the cavity 672, even when the dynamic drops 125,615 are relatively large (for example, long) and/or close to each other (which dynamic drops 125,615 might hinder the flow of the auxiliary fluid coming from the blowers 675). In addition or in alternative, each inlet pump 642,645 is actuated, so as to act in the cavity 672 through the removing port 120,609 and the removing duct 636,639. The blowers 675, the blowers 660 and/or the inlet pumps 642,645 create a vacuum between each delivering duct 618,621 and the corresponding removing duct 636,639; this causes the very fast suction of the solution 115,612 being delivered (without losing it) and of the auxiliary fluid (at least in part) through the outlet duct 636,639 towards the removing tank 648,651, with the formation of the dynamic drop 125,615. The pressure difference for obtaining this result depends on various contingent conditions (such as the type of solution 115,612, its inflow, the geometry of the deposition head 100 and the like). For example, the pressure difference, measured between each delivering port 110,606 and the corresponding removing port 120,609 may be equal to 0.5 kPa, preferably 1 kPa and still more preferably 3 kPa (such as up to 40 kPa).

Figure 7:
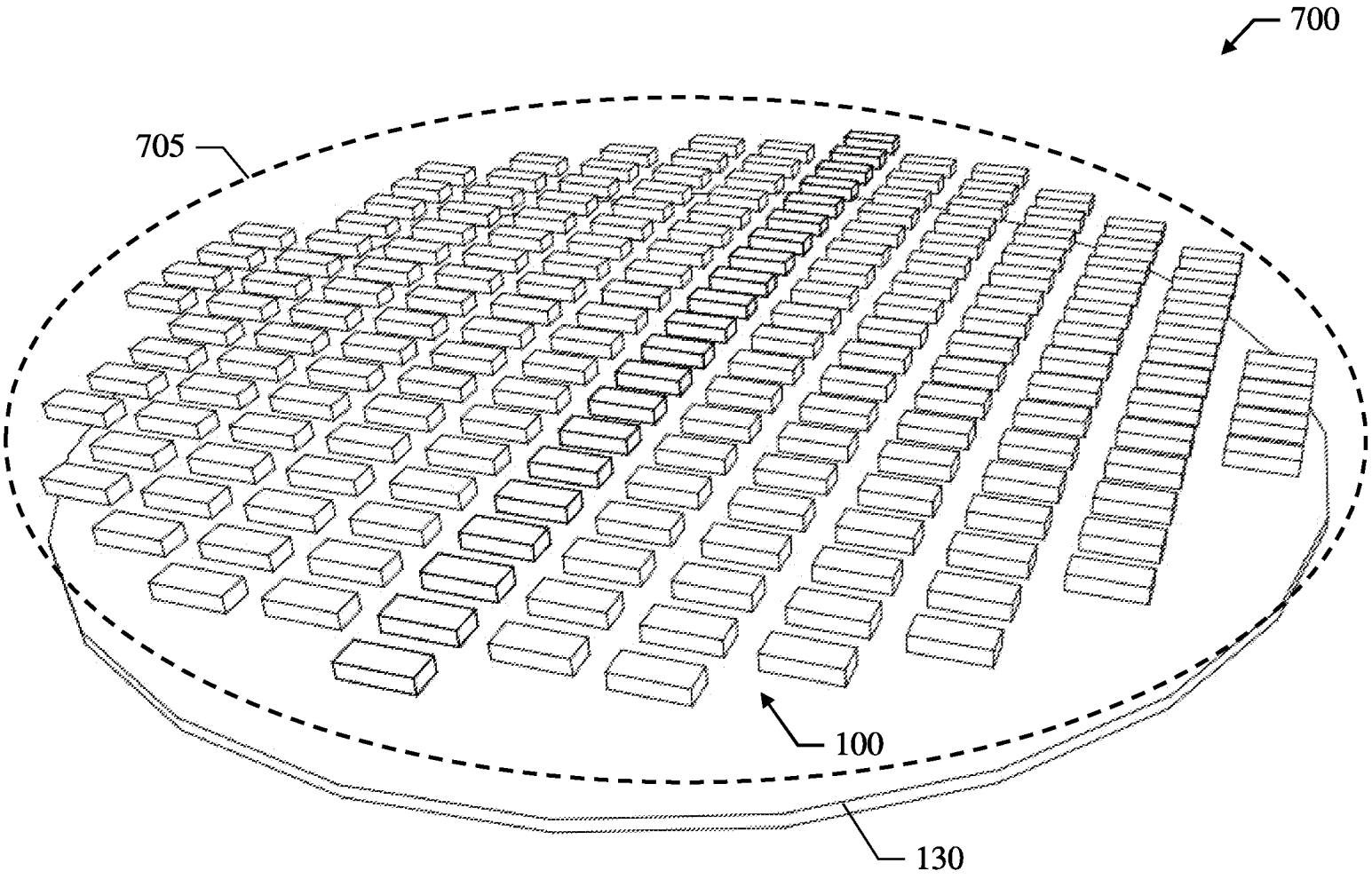
FIG. 7 shows a schematic representation in perspective of a deposition system according to another embodiment of the present invention.

With reference now to FIG. 7, a schematic representation is shown in perspective of a deposition system 700 according to another embodiment of the present invention.

In this case, the deposition system 700 comprises a plurality of deposition heads 100 for operating concurrently onto the substrate 130. For example, the substrate 130 is a wafer of semiconductor material; in this case, the deposition heads 100 are used to process (concurrently) identical regions of the wafer 130 intended to make corresponding chips of electronic devices in integrated form. The deposition heads 100 are arranged on a support element 705 (in phantom view in the figure) with a circular shape corresponding to the wafer 130; the deposition heads 100 are arranged in a matrix, with a plurality of rows and columns (of different length according to the available room on the support element 705). The substrate 130 is slidable reciprocally with respect to the support element 705 so as to reciprocally slide the substrate 130 with respect to the deposition heads 100 as above. As a result, the substrate 130 and the dynamic drops of the deposition heads 100 are brought into contact with each other in succession in groups (corresponding to the rows or columns of the matrix).

This allows making the multi-component structures of the electronic devices (for example, their interconnection elements) with a very high yield. Moreover, it is also possible to set the various deposition currents according to a distance of the corresponding delivering ports from a contact terminal (or more), which supplies the substrate 130. This makes it possible to segment the deposition currents with any desired granularity to compensate any non-uniformity thereof.

Naturally, in order to satisfy local and specific requirements, a person skilled in the art may apply many logical and/or physical modifications and alterations to the present disclosure. More specifically, although this disclosure has been described with a certain degree of particularity with reference to one or more embodiments thereof, it should be understood that various omissions, substitutions and changes in the form and details as well as other embodiments are possible. Particularly, different embodiments of the present disclosure may even be practiced without the specific details (such as the numerical values) set forth in the preceding description to provide a more thorough understanding thereof; conversely, well-known features may have been omitted or simplified in order not to obscure the description with unnecessary particulars. Moreover, it is expressly intended that specific elements and/or method steps described in connection with any embodiment of the present disclosure may be incorporated in any other embodiment as a matter of general design choice. Moreover, items presented in a same group and different embodiments, examples or alternatives are not to be construed as de facto equivalent to each other (but they are separate and autonomous entities). In any case, each numerical value should be read as modified by the term about (unless already done) and each range of numerical values should be intended as expressly specifying any possible number along the continuum within the range (comprising its end points). Moreover, ordinal or other qualifiers are merely used as labels to distinguish elements with the same name but do not by themselves connote any priority, precedence or order. Moreover, the terms include, comprise, have, contain, involve and the like should be intended with an open, non-exhaustive meaning (i.e., not limited to the recited items), the terms based on, dependent on, according to, function of and the like should be intended as a non-exclusive relationship (i.e., with possible further variables involved), the term a/an should be intended as one or more items (unless expressly indicated otherwise), and the term means for (or any means-plus-function formulation) should be intended as any structure adapted or configured for carrying out the relevant function.

For example, an embodiment provides a method for making a multi-component structure. However, the multi-component structure may be of any type (for example, any interconnection element of any electronic device, any protection element, a MEMS element, a probe and so on).

In an embodiment, the method comprises delivering a plurality of galvanic solutions (at least in part different from each other) for corresponding components of the multi-component structure. However, the galvanic solutions may be in any number and of any type, either all different among them or with some of them the same (for example, aqueous, ionic and so on solutions) and they may be delivered in any way (for example, by forcing them under pressure via pumps or other equivalent means, by simply leaving them to fall by gravity force and so on).

In an embodiment, the galvanic solutions are delivered through corresponding delivering ports being open on an operative surface of a deposition head. However, the deposition head may be of any type (for example, with a main body of any shape, size and material); the delivering ports may be of any shape and size, and they may be open with any arrangement on any operative surface (for example, aligned, in a matrix and the like on the operative surface facing downwards, upwards, vertically and so on).

In an embodiment, the method comprises removing the galvanic solutions delivered on the operative surface through a plurality of removing ports. However, the removing ports may be in any number and of any shape and size, for removing the galvanic solutions in any way (for example, by sucking the galvanic solutions through the removing ports, by forcing auxiliary fluid laterally in a cavity and/or by forcing ports and so on).

In an embodiment, for each of the delivering ports at least one of the removing ports is open on the operative surface at least in part around the delivering port. However, for each delivering port it is possible to provide any number of removing ports arranged in any way (for example, one or more removing ports surrounding the delivering port completely or only partially, one or more removing ports within the delivering port in addition or in alternative, and so on).

In an embodiment, the removal of the galvanic solutions creates corresponding dynamic drops. However, the dynamic drops may be of any shape and size, either static or dynamic (for example, semi-spherical, toroidal and so on).

In an embodiment, each dynamic drop is formed by the galvanic solution remaining attached in fixed position on the operative surface with a content of the dynamic drop that is continuously refreshed by a flow of the galvanic solution from the delivering port to the removing port. However, the dynamic drop may remain attached in any way (with or without any support) in any position (more or less wide around the delivering port), with its content that may be refreshed with any speed.

In an embodiment, the method comprises individually setting corresponding deposition currents for the galvanic solutions. However, the deposition currents may be set to any value and in any way (for example, by inserting them manually via any input means such as a keyboard, by reading them from file and so on).

In an embodiment, the deposition currents are set as a function of an amount of the components of the galvanic solutions in the multi-component structure. However, this result may be achieved with any formula (for example, by taking into account or not the deposition efficiency, by fixing the sliding speed, the deposition time, the thickness of the layers and/or the number of passages).

In an embodiment, the method comprises bringing a substrate and a plurality of groups each of one or more of the dynamic drops into contact with each other in succession. However, the substrate may be of any type (for example, a wafer, a product to be protected, a probe card, an encapsulation substrate, an electro-medical apparatus and so on) and it may be brought into contact in succession with any number of groups each of any number of dynamic drops in any way (for example, by moving only the substrate, only the deposition head or both of them, only in parallel or transversely as well to the operative surface).

In an embodiment, the dynamic drops transform into corresponding dynamic menisci between the operative surface and the substrate when entering into contact with the substrate and return the dynamic drops when separating from the substrate. However, the dynamic menisci may be of any shape and size and they may be obtained by bringing the substrate into contact with the dynamic drops in any way (for example, in parallel and/or transversely to the operative surface), returning the dynamic drops in any way (for example, at each passage or only at the end, by separating the substrate in any way either the same as or different from above).

In an embodiment, the method comprises applying the deposition currents at least between the galvanic solutions of the groups of dynamic drops and the substrate. However, the deposition currents may be applied in any way (for example, via current or voltage generators acting on one side on the galvanic solutions, such as directly in the delivering tanks/ducts, via corresponding insulated portions of the deposition heads, on conductive inserts thereof and the like, and on the other side on the substrate, such as in one or more points via the conveyor, one or more further dynamic drops of conductive solutions and the like), to all the galvanic solutions or only to the ones of the groups of dynamic drops.

In an embodiment, the dynamic menisci galvanically deposit layers of the corresponding components of the multi-component structure onto the substrate. However, the layers may be in any number and of any thickness.

In an embodiment, the method comprises delivering one or more rinsing solutions. However, the rinsing solutions may be in any number and of any type, either the same or different from each other (or they may even be completely lacking) and they may be delivered in any way (either the same or different with respect to the galvanic solutions).

In an embodiment, the rinsing solutions are delivered through corresponding further delivering ports being open on the operative surface. However, the further delivery ports may have any shape, size and arrangement (either the same or different with respect to the delivering ports).

In an embodiment, the method comprises removing the rinsing solutions delivered on the operative surface through one or more further removing ports. However, the further removing ports may be in any number and of any shape and size, for removing the rinsing solutions in any way (either the same or different with respect to the galvanic solutions).

In an embodiment, for each of the further delivering ports one or more of the further removing ports are open on the operative surface at least in part around the further delivering port. However, for each further delivering port it is possible to provide any number of further removing ports arranged in any way (either the same or different with respect to above).

In an embodiment, the removal of the rinsing solutions creates corresponding further dynamic drops. However, the further dynamic drops may be of any static or dynamic shape and size (either the same or different with respect to the dynamic drops).

In an embodiment, each further dynamic drop is formed by the rinsing solution remaining attached in fixed position on the operative surface with a content of the further dynamic drop that is continuously refreshed by a flow of the rinsing solution from the further delivering port to the further removing port. However, the further dynamic drop may remain attached in any way and in any position, with its content that may be refreshed with any speed (either the same or different with respect to the dynamic drops).

In an embodiment, the method comprises bringing the substrate and one or more further groups each of one or more of the further dynamic drops into contact with each other after at least a previous one of the groups of dynamic drops. However, the substrate may be brought into contact with any number of further groups each of any number of further dynamic drops after any number of groups of dynamic drops (either for all the dynamic drops or for part of them only).

In an embodiment, the further dynamic drops transform into corresponding further dynamic menisci between the operative surface and the substrate when entering into contact with the substrate and return the further dynamic drops when separating from the substrate. However, the further dynamic menisci may be of any shape and size (either the same or different with respect to the dynamic menisci).

In an embodiment, the further dynamic menisci of each of the further groups of dynamic drops rinse the substrate from the galvanic solutions of the dynamic menisci of the previous group of dynamic drops. However, the rinsing may take place in any way (for example, only on the corresponding layers or part thereof, on the operative surface, for all the galvanic solutions or only for the most critical ones, and so on).

In an embodiment, the method comprises repeating alternately bringing the substrate and the groups of dynamic drops into contact with each other in a first order and bringing the substrate and the groups of dynamic drops into contact with each other in a second order opposite the first order. However, the two orders may be obtained with relative movements in any direction (for example, back and forth, up and down, and so on) and they may be alternated in any way (for example, one or more in one way and one or more in another, either fixed or variable); in any case, the possibility is not excluded to act on the substrate in more ways or even always in a single way (for example, by separating the substrate and the dynamic drops in the other way).

In an embodiment, the method comprises stopping said delivering the galvanic solutions and/or said applying the deposition currents for all the delivering ports during said bringing the substrate and the groups of dynamic drops into contact with each other in the second order. However, for this purpose it is possible to stop the delivering of the galvanic solutions only, the application of the deposition currents only or both of them in any direction (even none).

In an embodiment, the method comprises stopping said delivering the galvanic solutions and/or said applying the deposition currents for the groups of delivering ports different from at least a selected one of the groups of delivering ports during part of said bringing the substrate and the groups of dynamic drops into contact with each other in succession. However, for this purpose it is possible to stop the delivering of the galvanic solutions only, the application of the deposition currents only or both of them at any time (even none) for using any number of groups of selected delivering ports.

In an embodiment, the method comprises setting the deposition currents further as a function of a distance of the corresponding delivering ports from a power supply terminal of the substrate. However, the deposition currents may be set as a function of their distance in any way (for example, in groups or individually), with this feature that may also be omitted at all.

In an embodiment, the method comprises delivering the galvanic solutions at a speed between 0.1 and 10.00 m/s. However, the galvanic solutions may be delivered at any speed.

In an embodiment, the thicknesses of the depositing layers are comprised between 0.01 μm and 0.50 μm. However, the layers may have any thickness.

In an embodiment, the method comprises forcing an auxiliary fluid into a cavity defined by a restraining surface facing the operative surface for facilitating said removing the galvanic solutions. However, the cavity may have any shape and size, and it may be defined in any way (for example, made as a whole or in part by means of the conveyor, by means of a dedicated structure and so on); moreover, the auxiliary fluid may be of any type (for example, air, nitrogen and so on) and it may be forced into the cavity in any way (for example, transversely and/or in parallel to the operative surface).

In an embodiment, the method comprises forcing the auxiliary fluid into the cavity sideways and/or through corresponding forcing ports being open on the operative surface. However, the auxiliary fluid (either the same or different) may be forced by any means only sideways (at any number of positions), only through the forcing ports (in any number and with any shape and size), in both ways or even in none of them.

In an embodiment, each forcing port is arranged between first one or more of the removing ports and/or of the further removing ports and second one or more of the removing ports and/or of the further removing ports. However, the forcing ports may be arranged in any way (each between any number of removing ports, further removing ports or any combination thereof).

In an embodiment, the method comprises sucking the galvanic solutions and/or the rinsing solutions delivered on the operative surface through the corresponding removing ports and further removing ports, respectively. However, the (galvanic and/or rinsing) solutions may be sucked with any means (for example, pumps, fans and so on) or even freely (when the pressure difference created by the auxiliary fluid is enough).

In an embodiment, the method comprises bringing the substrate and the groups of dynamic drops into contact with each other in succession by sliding the substrate and the deposition head relative to each other in parallel to the operative surface. However, this result may be obtained in any way (for example, by bringing the substrate beyond the processing head or not at one or both ends of their mutual sliding).

In an embodiment, the method comprises bringing the substrate and a first one of the groups of dynamic drops groups into contact with each other by moving the substrate and the deposition head relative to each other transversely to the operative surface prior to said sliding the substrate and the deposition head. However, the dynamic drops may be brought in this way into contact with any portion of the substrate (with such feature that may however be omitted at all), one or more times as well during the sliding.

In an embodiment, the method comprises feeding the substrate to the deposition head by a conveyor comprising the restraining surface. However, the conveyor may be of any type (for example, a platform, a belt, with or without any lifter such as hydraulic, mechanic pistons, and so on).

In an embodiment, the method comprises bringing a plurality of further substrates and the groups of dynamic drops into contact with each other in succession without interrupting said delivering and said removing the galvanic solutions and/or the rinsing solutions. However, it is possible to maintain without interruption the galvanic solutions only, the rinsing solutions only or both of them; in any case, the possibility is not excluded of stopping the flow of all the solutions between the processing of different substrates (for example, to reduce their consumption).

In an embodiment, the method comprises delivering the galvanic solutions through delivering ducts ending into the corresponding delivering ports and removing the galvanic solutions delivered on the operative surface through removing ducts ending into the corresponding removing ports and/or delivering the rinsing solutions through further delivering ducts ending into the corresponding further delivering ports and removing the rinsing solutions delivered on the operative surface through further removing ducts ending into the corresponding further removing ports. However, these ducts may have any shape and size (for example, rectilinear in whole or in part, curved, at zigzag and so on).

In an embodiment, each of the delivering ducts and the corresponding removing duct and/or each of the further delivering ducts and the corresponding further removing duct extend in the deposition head with an arrangement at least in part divergent moving away from the operative surface. However, the ducts may diverge with any angle or even be parallel to each other.

In an embodiment, the multi-component structure is included in an interconnection element of an electronic device. However, the interconnection element may be of any material (for example, solder alloy with three or more components) and of any type (for example, BGA, micro-BGA, "copper pillar" and so on).

Generally, similar considerations apply if the same solution is implemented with an equivalent method (by using similar steps with the same functions of more steps or portions thereof, removing some non-essential steps or adding further optional steps); moreover, the steps may be performed in a different order, concurrently or in an interleaved way (at least in part).

An embodiment provides a deposition system for making one or more multi-component structures comprising means configured for performing each of the steps of the above-mentioned method. Particularly, the deposition system comprises one or more deposition heads. Each deposition head comprises a plurality of delivering ports (being open on an operative surface of the deposition head for delivering corresponding galvanic solutions at least in part different from each other for corresponding components of the multi-component structures). The deposition head comprises a plurality of removing ports (for removing the galvanic solutions delivered on the operative surface); for each of the delivering ports, one or more of the removing ports are open on the operative surface at least in part around the delivering port. This allows creating corresponding dynamic drops, each formed by the galvanic solution remaining attached in fixed position on the operative surface (with a content of the dynamic drop that is continuously refreshed by a flow of the galvanic solution from the delivering port to the removing port). The deposition system comprises means for individually setting corresponding deposition currents for the galvanic solutions (as a function of an amount of the components of the galvanic solutions in the multi-component structures). The deposition system comprises means for bringing each of one or more substrates and a plurality of groups each of one or more of the dynamic drops into contact with each other in succession; the dynamic drops transform into corresponding dynamic menisci between the operative surface and the substrate when entering into contact with the substrate and return the dynamic drops when separating from the substrate. The deposition system comprises means for applying the deposition currents between the galvanic solutions of the groups of dynamic drops and each of the substrates (thereby causing the dynamic menisci to galvanically deposit layers of the corresponding components of the multi-component structure onto the substrate). However, the deposition head may be of any type and with means each implemented with any structure (see above), and the processing heads may be in any number and arranged in any way (for example, in a matrix for any shape such as round, square and the like, aligned, with the processing heads separated from each other, contiguous, facing and so on) for acting on any number of substrates in any way (for example, on one or more opposite surfaces thereof at the same time, in parallel and/or in sequence and so on).

Generally, similar considerations apply if the deposition system has a different structure or comprises equivalent components (for example, of different materials) or it has other operative characteristics. In any case, every component thereof may be separated into more elements, or two or more components may be combined together into a single element; moreover, each component may be replicated to support the execution of the corresponding operations in parallel. Moreover, unless specified otherwise, any interaction between different components generally does not need to be continuous, and it may be either direct or indirect through one or more intermediaries.

The invention claimed is:

1. A method for making a multi-component structure, wherein the method comprises:

delivering a plurality of galvanic solutions at least in part different from each other for corresponding components of the multi-component structure through corresponding delivering ports being open on an operative surface of a deposition head, removing the galvanic solutions delivered on the operative surface through a plurality of removing ports, for each of the delivering ports at least one of the removing ports being open on the operative surface at least in part around the delivering port, thereby creating corresponding dynamic drops each formed by the galvanic solution remaining attached in fixed position on the operative surface with a content of the dynamic drop that is continuously refreshed by a flow of the galvanic solution from the delivering port to the removing port, individually setting corresponding deposition currents for the galvanic solutions as a function of an amount of the components of the galvanic solutions in the multi-component structure, bringing a substrate and a plurality of groups each of one or more of the dynamic drops into contact with each other in succession repeatedly during a relative movement of the substrate and the deposition head along a sliding direction alternately in a first orientation and in a second orientation opposite the first orientation, the dynamic drops transforming into corresponding dynamic menisci between the operative surface and the substrate when entering into contact with the substrate and returning the dynamic drops when separating from the substrate, and applying the deposition currents at least between the galvanic solutions of the groups of dynamic drops and the substrate thereby causing the dynamic menisci to galvanically deposit layers of the corresponding components of the multi-component structure onto the substrate.

2. The method according to claim 1, wherein the method comprises:

delivering one or more rinsing solutions through corresponding further delivering ports being open on the operative surface, removing the rinsing solutions delivered on the operative surface through one or more further removing ports, for each of the further delivering ports one or more of the further removing ports being open on the operative surface at least in part around the further delivering port, thereby creating corresponding further dynamic drops each formed by the rinsing solution remaining attached in fixed position on the operative surface with a content of the further dynamic drop that is continuously refreshed by a flow of the rinsing solution from the further delivering port to the further removing port, and bringing the substrate and one or more further groups each of one or more of the further dynamic drops into contact with each other after at least a previous one of the groups of dynamic drops, the further dynamic drops transforming into corresponding further dynamic menisci between the operative surface and the substrate when entering into contact with the substrate and returning the dynamic drops when separating from the substrate, the further dynamic menisci of each of the further groups of dynamic drops rinsing the substrate from the galvanic solutions of the dynamic menisci of the previous group of dynamic drops.

3. The method according to claim 2, wherein the method comprises:

forcing an auxiliary fluid into a cavity defined by a restraining surface facing the operative surface for facilitating said removing the rinsing solutions sideways and/or through corresponding forcing ports being open on the operative surface each between first one or more of the further removing ports and second one or more of the further removing ports.

4. The method according to claim 2, wherein the method comprises:

sucking the rinsing solutions delivered on the operative surface through the corresponding further removing ports.

5. The method according to claim 2, wherein the method comprises:

bringing a plurality of further substrates and the further groups of further dynamic drops into contact with each other in succession without interrupting said delivering and said removing the rinsing solutions.

6. The method according to claim 2, wherein the method comprises:

delivering the rinsing solutions through further delivering ducts ending into the corresponding further delivering ports and removing the rinsing solutions delivered on the operative surface through further removing ducts ending into the corresponding further removing ports, each of the further delivering ducts and the corresponding further removing duct extending in the deposition head with an arrangement at least in part divergent moving away from the operative surface.

7. The method according to claim 1, wherein the method comprises:

bringing the substrate and the groups of dynamic drops into contact with each other in a first order during the relative movement along the sliding direction in the first orientation, and bringing the substrate and the groups of dynamic drops into contact with each other in a second order opposite the first order during the relative movement along the sliding direction in the second orientation.

8. The method according to claim 7, wherein the method comprises:

stopping said delivering the galvanic solutions and/or said applying the deposition currents for all the delivering ports during said bringing the substrate and the groups of dynamic drops into contact with each other in the second order.

9. The method according to claim 1, wherein the method comprises:

stopping said delivering the galvanic solutions and/or said applying the deposition currents for the groups of delivering ports different from at least a selected one of the groups of delivering ports during part of said bringing the substrate and the groups of dynamic drops into contact with each other in succession.

10. The method according to claim 1, wherein the method comprises:

setting the deposition currents further as a function of a distance of the corresponding delivering ports from a power supply terminal of the substrate.

11. The method according to claim 1, wherein the method comprises:

delivering the galvanic solutions at a speed between 0.1 and 10.00 m/s.

12. The method according to claim 1, wherein the method comprises:

galvanically depositing layers with a thickness comprised between 0.01 μm and 0.50 μm.

13. The method according to claim 1, wherein the method comprises:

forcing an auxiliary fluid into a cavity defined by a restraining surface facing the operative surface for facilitating said removing the galvanic solutions.

14. The method according to claim 13, wherein the method comprises:

forcing the auxiliary fluid into the cavity sideways and/or through corresponding forcing ports being open on the operative surface each between first one or more of the removing ports and second one or more of the removing ports.

15. The method according to claim 13, wherein the method comprises:

feeding the substrate to the deposition head by a conveyor comprising the restraining surface.

16. The method according to claim 1, wherein the method comprises:

sucking the galvanic solutions delivered on the operative surface through the corresponding removing ports.

17. The method according to claim 1, wherein the method comprises:

bringing the substrate and the groups of dynamic drops into contact with each other in succession by sliding the substrate and the deposition head relative to each other in parallel to the operative surface.

18. The method according to claim 17, wherein the method comprises:

bringing the substrate and a first one of the groups of dynamic drops groups into contact with each other by moving the substrate and the deposition head relative to each other transversely to the operative surface prior to said sliding the substrate and the deposition head.

19. The method according to claim 1, wherein the method comprises:

bringing a plurality of further substrates and the groups of dynamic drops into contact with each other in succession without interrupting said delivering and said removing the galvanic solutions.

20. The method according to claim 1, wherein the method comprises:

delivering the galvanic solutions through delivering ducts ending into the corresponding delivering ports and removing the galvanic solutions delivered on the operative surface through removing ducts ending into the corresponding removing ports, each of the delivering ducts and the corresponding removing duct extending in the deposition head with an arrangement at least in part divergent moving away from the operative surface.

21. The method according to claim 1, wherein the method comprises:

making the multi-component structure included in an interconnection element of an electronic device.

* * * * *